US011505933B2

(12) United States Patent
Kitaura et al.

(10) Patent No.: US 11,505,933 B2
(45) Date of Patent: Nov. 22, 2022

(54) FLUSH WATER TANK APPARATUS AND FLUSH TOILET APPARATUS EQUIPPED WITH SAME

(71) Applicant: TOTO LTD., Kitakyushu (JP)

(72) Inventors: Hidekazu Kitaura, Kitakyushu (JP); Nobuhiro Hayashi, Kitakyushu (JP); Akihiro Shimuta, Kitakyushu (JP); Masahiro Kuroishi, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 16 days.

(21) Appl. No.: 16/984,623

(22) Filed: Aug. 4, 2020

(65) Prior Publication Data

US 2021/0040718 A1 Feb. 11, 2021

(30) Foreign Application Priority Data

Aug. 5, 2019 (JP) ..... JP2019-143529
Aug. 5, 2019 (JP) ..... JP2019-143530

(51) Int. Cl.
*E03D 5/02* (2006.01)
*E03D 5/10* (2006.01)
*E03D 1/34* (2006.01)

(52) U.S. Cl.
CPC ..... *E03D 5/024* (2013.01); *E03D 1/34* (2013.01); *E03D 5/105* (2013.01)

(58) Field of Classification Search
CPC ... E03D 5/02; E03D 5/024; E03D 1/08; F03B 13/00; F03B 13/06
See application file for complete search history.

(56) References Cited

U.S. PATENT DOCUMENTS 3,994,029 A * 11/1976 Badders ..... E03D 5/024 137/445
4,230,145 A * 10/1980 Badders ..... E03D 1/30 137/410
6,536,053 B2 * 3/2003 Icking ..... E03D 1/142 4/406
9,834,918 B2 * 12/2017 Veros ..... E03D 5/026
10,233,898 B1 * 3/2019 Tang ..... F03B 17/062
10,819,186 B2 * 10/2020 Conness ..... F03B 13/00
(Continued)

FOREIGN PATENT DOCUMENTS

JP 2015-178728 A 10/2015

*Primary Examiner* — David P Angwin
*Assistant Examiner* — Nicholas A Ros
(74) *Attorney, Agent, or Firm* — Studebaker & Brackett PC

(57) ABSTRACT

A flush water tank apparatus capable of opening and closing a discharge valve without the use of an external power source. A flush water tank apparatus includes a reservoir tank having a discharge opening; a discharge valve which opens and closes to supply and shut off the supply of flush water to the flush toilet; a discharge valve hydraulic drive portion, which uses the supply pressure of supplied municipal water to drive the discharge valve; an electric generator for generating electrical power using the flow of supplied municipal water; an electromagnetic valve operated by electrical power generated by the generator; and a water supply control device for controlling the supply of water to the discharge valve hydraulic drive portion based on the operation of the electromagnetic valve, and for controlling the supply of water to the reservoir tank.

11 Claims, 6 Drawing Sheets

(56) References Cited

U.S. PATENT DOCUMENTS

| | | | | |
|---|---|---|---|---|
| 2003/0041370 | A1* | 3/2003 | Chung | E03D 3/00 4/300 |
| 2009/0211009 | A1* | 8/2009 | Yen | E03D 5/024 4/407 |
| 2015/0267387 | A1 | 9/2015 | Shinohara et al. | |
| 2018/0062481 | A1* | 3/2018 | Alexander | H04N 9/3141 |
| 2020/0057457 | A1* | 2/2020 | Halimi | G08B 3/10 |

* cited by examiner

FLUSH WATER TANK APPARATUS AND FLUSH TOILET APPARATUS EQUIPPED WITH SAME

CROSS-REFERENCE TO RELATED APPLICATION

This application claims benefit of priority to Japanese Patent Application No. 2019-143529, filed Aug. 5, 2019, and Japanese Patent Application No. 2019-143530, filed Aug. 5, 2019, the entire contents of which are incorporated herein by reference.

BACKGROUND

Technical Field

The present disclosure pertains to a flush water tank apparatus, and more particularly to a flush water tank apparatus and flush toilet apparatus comprising same in which self-generated electrical power is used to supply flush water to the flush toilet.

Background Art

Japanese Published Unexamined Patent Application 2015-178728 sets forth a discharge apparatus for discharging flush water from a flush toilet flush water tank. In this discharge apparatus, when a signal is input instructing the flush toilet to flush, an electrically driven motor built into a power control unit is activated and a pulley attached to the electrically driven motor winds a wire serving as a linking member for powered operation. By winding the wire, a discharge valve in the flush water tank is pulled up, opening the discharge valve and flushing the flush toilet. A flush toilet can thus be flushed based on a detection signal from a human-presence sensor placed in the flush toilet, or based on the operation of a lightweight button or the like by a user, without having to operate a flush lever to mechanically raise a discharge valve.

SUMMARY

However, in the discharge apparatus set forth in JP 2015-178728, the discharge valve is opened by an electric motor driving a pulley, therefore electrical power is required to operate the electric motor. This presents the problem that such a discharge apparatus cannot be installed in an environment where an external power source is unavailable. Even if a discharge apparatus is installed in an environment where an external power source is available, the problem arises that the apparatus cannot be operated and the flush toilet cannot be flushed during a power outage.

Alternatively, installation of a discharge apparatus such as that set forth in JP 2015-178728 is conceivable in environments where no external power supply is available by operating the discharge apparatus with a primary battery. However this raises the problem that power consumption by an electrically powered drive motor to hoist up the discharge valve is high and requires a high capacity primary battery. An additional problem is that when operating a discharge apparatus using a primary battery, the battery must be replaced periodically, thus increasing the maintenance burden.

In addition, electrical power could conceivably be generated by a generator using the flow of water being supplied to a flush water tank to operate an electrically driven motor in a discharge apparatus with this electrical power. However, the amount of power which can be generated based on the supply of flush water is small, making it difficult to operate an electrically driven motor with this electrical power. In addition, due to the requirement for water conservation in recent years, the amount of flush water used for toilet flushing is on a diminishing trend, and correspondingly the amount of flush water stored in flush water tanks is also decreasing. Therefore securing the requisite electrical power to operate an electrically driven motor by electrical generation is expected to become ever more difficult in the future.

The present disclosure therefore provides a flush water tank apparatus and flush toilet apparatus equipped with same capable of opening and closing a discharge valve without the use of an external power source.

The disclosed embodiment is a flush water tank apparatus for supplying flush water to a flush toilet using self-generated electrical power, comprising a reservoir tank for storing flush water to be supplied to the flush toilet, in which a discharge opening is formed for discharging stored flush water to the flush toilet; a discharge valve which opens and closes to supply and shut off the supply of flush water to the flush toilet; a discharge valve hydraulic drive portion which drives the discharge valve by using the supply pressure of supplied municipal water; an electric generator for generating electrical power using the flow of supplied municipal water; an electromagnetic valve operated by electrical power generated by the generator; and a water supply control device for controlling the supply of water to the discharge valve hydraulic drive portion and controlling the supply and shutting off of the supply of water to the reservoir tank based on the operation of this electromagnetic valve.

In the disclosed present embodiment thus constituted, a generator produces electrical power by the flow of supplied municipal water, and an electromagnetic valve is operated by the electrical power. A water supply control device controls the supply of water to the discharge valve hydraulic drive portion based on operation of an electromagnetic valve, and controls the supply and shutting off of water to a reservoir tank. When water is supplied to a discharge valve hydraulic drive portion, the discharge valve hydraulic drive portion utilizes the supply pressure of supplied municipal water to drive a discharge valve, and by opening the discharge valve, discharges flush water in a reservoir tank into a flush toilet.

In the disclosed embodiment thus constituted, the supply of water to a discharge valve hydraulic drive portion by a water supply control device is performed based on operation of an electromagnetic valve, and a discharge valve hydraulic drive portion utilizes the pressure of supplied municipal water to drive a discharge valve. Therefore a discharge valve can be driven by merely operating an electromagnetic valve using a small amount of power to discharge flush water in a reservoir tank into a flush toilet. Also, in the present disclosure electrical power produced by a generator is utilized to operate an electromagnetic valve, and based on the a discharge valve is driven, therefore required electrical power can be supplied by the generator to control the discharge of water. Thus the flush water tank apparatus of the present disclosure can be installed even in environments where no external power source is available, and maintenance such as changing of batteries can be minimized.

Also, the disclosed embodiment is a flush toilet apparatus comprising: the flush water tank apparatus of the present disclosure, and a flush toilet flushed by flush water supplied from the flush water tank apparatus.

DETAILED DESCRIPTION

Next, referring to the attached drawings, we explain a flush toilet apparatus according to a first embodiment of the disclosure.

Figure 1:
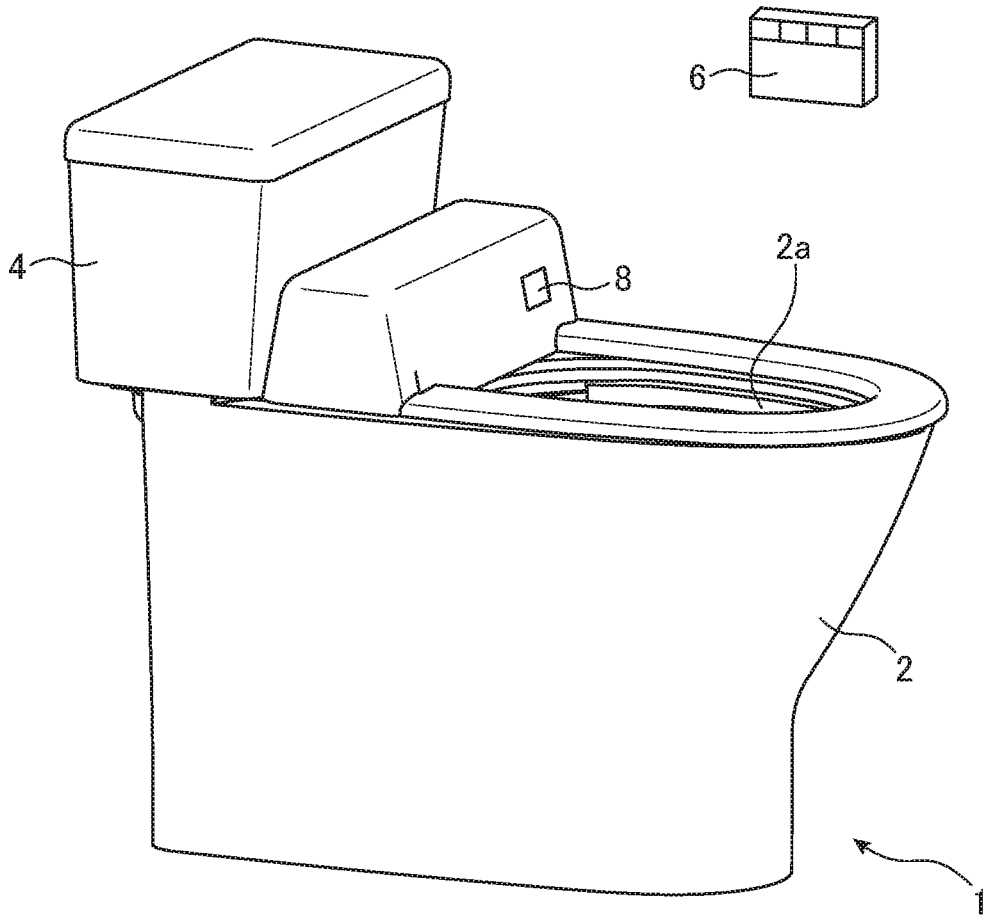
FIG. 1 is a perspective view showing the entirety of a flush toilet apparatus comprising a flush water tank according to a first embodiment of the disclosure.
Figure 2:
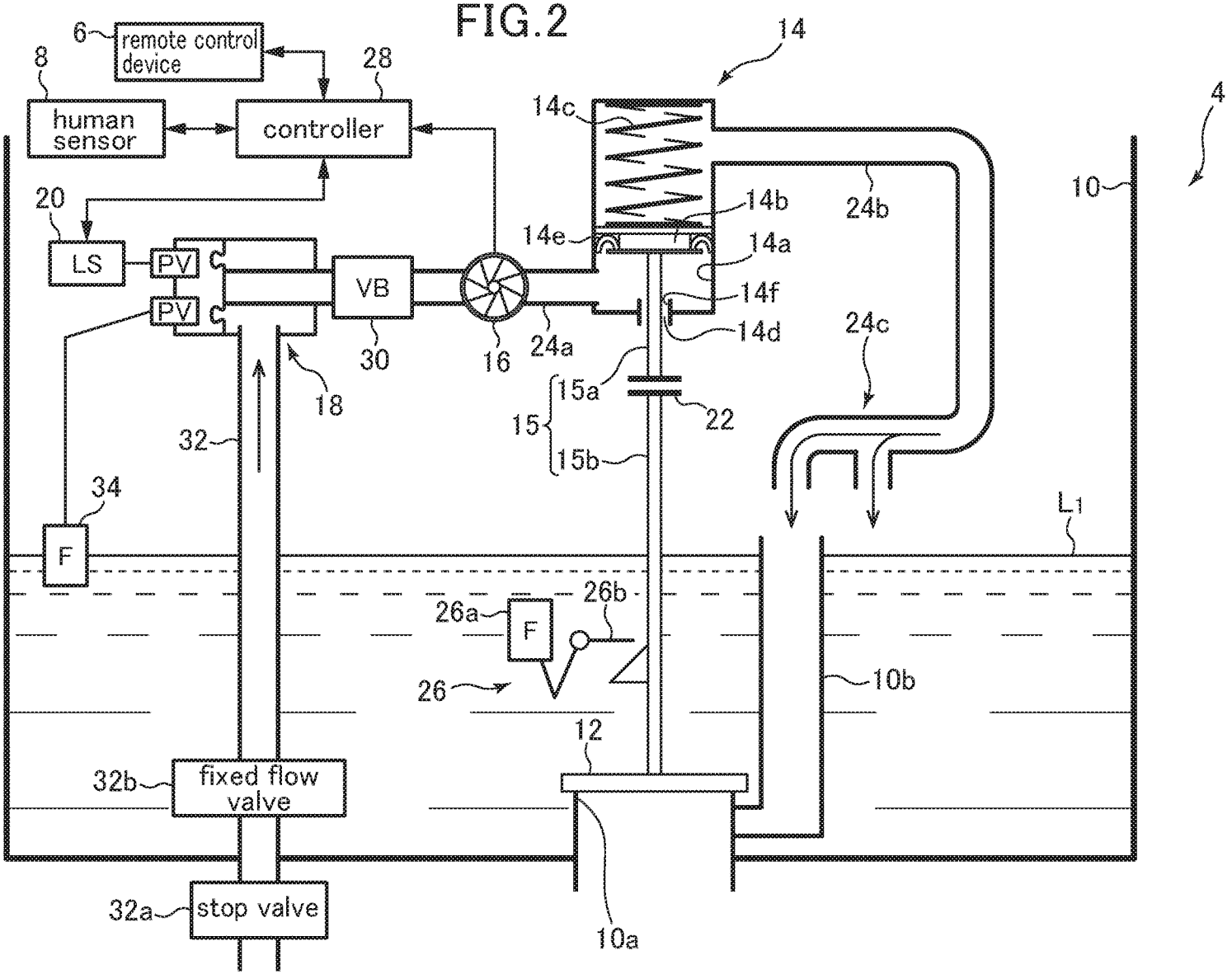
FIG. 2 is a cross section showing the constitution of a flush water tank apparatus according to a first embodiment of the present disclosure.
Figure 3:
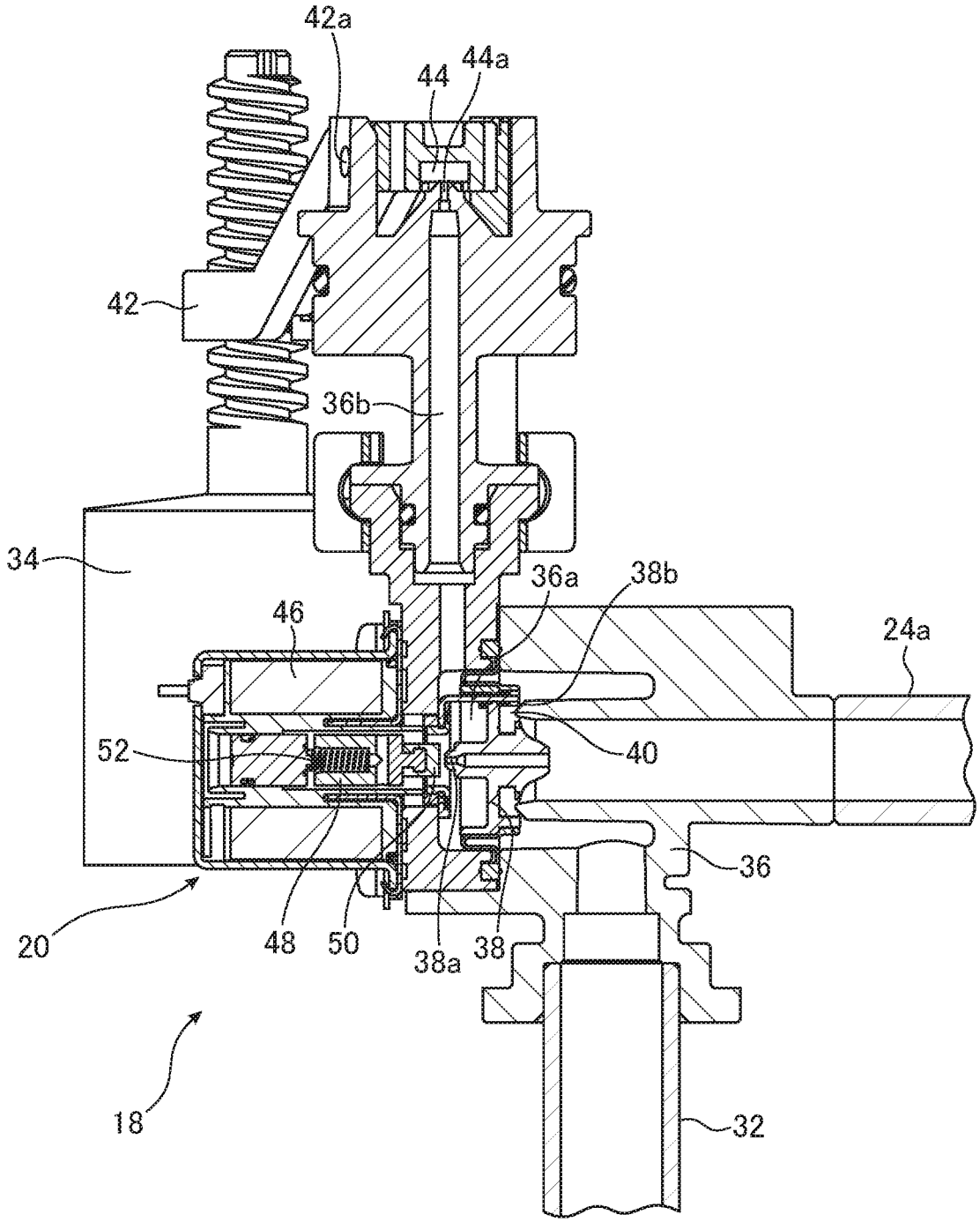
FIG. 3 is a cross section showing a water supply control device provided in a flush water tank apparatus according to a first embodiment of the disclosure.

FIG. 1 is a perspective view showing the entirety of a flush toilet apparatus comprising a flush water tank according to a first embodiment of the disclosure. FIG. 2 is a cross section showing the constitution of a flush water tank apparatus according to a first embodiment of the present disclosure. FIG. 3 is a cross section showing a water supply control device provided in a flush water tank apparatus according to a first embodiment of the disclosure.

As shown in FIG. 1, a flush toilet apparatus 1 according to an embodiment of the disclosure is constituted by a flush toilet main unit 2, being a flush toilet, and a flush water tank apparatus 4 according to a first embodiment of the disclosure, mounted at the rear portion of the flush toilet main unit 2. The flush toilet apparatus 1 of the present embodiment is constituted so that flushing of the bowl portion 2*a* of the flush toilet main unit 2 is brought about either by operation, after use, of a remote control device 6 attached to the wall, or by the elapse of a predetermined time after a human presence sensor 8 positioned on the toilet seat senses that a user has separated from the toilet seat. The flush water tank apparatus 4 according to the present embodiment is constituted so that flush water stored within is discharged to the flush toilet main unit 2 based on a command signal from the remote control device 6 or the human presence sensor 8, thereby flushing the bowl portion 2*a* with the flush water. Although in the present embodiment the human presence sensor 8 is positioned on the toilet seat, the disclosure is not limited to this form, and the sensor may be placed in a position where a user's sitting on or separation from the seat, approach or departure, or hand swiping action can be sensed, for example on the flush toilet main unit 2 or the flush water tank apparatus 4. It is sufficient for the human presence sensor 8 to be capable of sensing a user's arrival on the seat, separation or approach to the seat, removal, or hand swiping action; for example an infrared sensor or microwave sensor may be used as the human presence sensor 8.

As shown in FIG. 2, the flush water tank apparatus 4 has: a reservoir tank 10 for storing flush water to be supplied to the flush toilet main unit 2, a discharge valve 12 for opening and closing a discharge opening 10*a* disposed on the reservoir tank 10, and a discharge valve hydraulic drive portion 14 for driving the discharge valve 12. In addition, the flush water tank apparatus 4 has a generator 16 disposed on the water conduit supplying water to the discharge valve hydraulic drive portion 14, a water supply control device 18 for controlling the supply of water to the discharge valve hydraulic drive portion 14 and into the reservoir tank 10, and an electromagnetic valve 20, attached to the water supply control device 18, which operates using electrical power produced by the generator 16. The generator 16, the discharge valve hydraulic drive portion 14, the water supply control device 18 and the electromagnetic valve 20 are located inside the reservoir tank 10.

The reservoir tank 10 is a tank constituted to store flush water for supply to the flush toilet main unit 2; at the bottom portion thereof a discharge opening 10*a* is formed for discharging stored flush water to the flush toilet main unit 2. Within the reservoir tank 10, an overflow pipe 10*b* is connected on the downstream side of the discharge opening 10*a*. This overflow pipe 10*b* rises vertically near the discharge opening 10*a* and extends above the surface of the flush water stored in the reservoir tank 10. Therefore flush water flowing in from the top end of the overflow pipe 10*b* bypasses the discharge opening 10*a* and flows directly out to the flush toilet main unit 2.

The discharge valve 12 is a valve body disposed so as to open and close the discharge opening 10*a;* the discharge valve 12 is opened by being pulled up vertically by the discharge valve hydraulic drive portion 14, and flush water in the reservoir tank 10 is discharged to the flush toilet main unit 2, thereby flushing the bowl portion 2*a*. The discharge valve 12 operates vertically within a casing (not shown).

The discharge valve hydraulic drive portion 14 is constituted to drive the discharge valve 12 by utilizing the supply water pressure of flush water supplied from a water utility. Specifically, the discharge valve hydraulic drive portion 14 has: a cylinder 14*a* into which water supplied from the water supply control device 18 flows, a piston 14*b* slidably disposed within the cylinder 14*a,* and a rod 15 projecting from the bottom end of cylinder 14*a* to drive the discharge valve 12. In addition, a spring 14*c* is disposed on the interior of cylinder 14*a;* this biases the piston 14*b* downward, and a packing 14*e* is attached to the piston 14*b* to secure watertightness between the interior wall surface of the cylinder 14*a* and the piston 14*b*. A clutch mechanism 22 is disposed midway along the rod 15; the rod 15 is separated into an upper rod 15*a* and a lower rod 15*b* by means of the clutch mechanism 22.

The cylinder 14*a* is a cylindrical member; the axial line thereof is disposed in the vertical direction, and the piston 14*b* is slidably received on the interior thereof. The cylinder 14*a* is mounted on the casing (not shown) of the discharge valve 12. An inflow pipe 24*a* serving as a drive portion water supply conduit is attached at the bottom end portion of the cylinder 14*a,* and water flowing out from the water supply control device 18 flows into the cylinder 14*a*. Therefore the piston 14*b* inside the cylinder 14*a* is pushed up in opposition to the biasing force of a spring 14*c* by water flowing into cylinder 14*a*.

At the same time, an outflow hole is disposed on the top end portion of the cylinder 14*a,* and the outflow pipe 24*b,* which is the drive portion discharge conduit, communicates with the interior of the cylinder 14*a* through the outflow hole. Therefore when water flows into the cylinder 14*a* from the inflow pipe 24*a* connected to the bottom portion of the cylinder 14*a,* the piston 14*b* is pushed up from the bottom portion of the cylinder 14*a,* which is at a first position. When the piston 14*b* is pushed up to a second position above the outflow hole, water which has flowed into the cylinder 14*a* flows out from the outflow hole through the outflow pipe 24*b.* That is, the inflow pipe 24*a* and the outflow pipe 24*b* communicate through the interior of the cylinder 14*a* when the piston 14*b* is moved to a second position. An outflow pipe branching portion 24*c* is disposed at the end portion of the outflow pipe 24*b* which extends from the cylinder 14*a.* One side of the outflow pipe 24*b,* which branches in the outflow pipe branching portion 24*c,* causes water in the reservoir tank 10 to flow out, while the other side causes water to flow out into the overflow pipe 10*b.* Therefore a portion of water flowing out from the cylinder 14*a* is discharged through the overflow pipe 10*b* into the flush toilet main unit 2, while the remainder is stored in the reservoir tank 10.

The rod 15 is a rod-shaped member connected to the undersurface of the piston 14*b;* it passes through a through-hole 14*f* formed on the bottom of the cylinder 14*a,* and extends so as to project downward from the middle of the cylinder 14*a.* A discharge valve 12 is connected to the bottom end of the rod 15, and the rod 15 links the piston 14*b* and the discharge valve 12. Therefore when water flows into the cylinder 14*a* pushing the piston 14*b* up, the rod 15 connected to the piston 14*b* pulls the discharge valve 12 upward, opening the discharge valve 12.

A gap 14*d* is disposed between the rod 15 projecting from the beneath cylinder 14*a* and the inside wall of the through-hole 14*f* in the cylinder 14*a;* a portion of water flowing into the cylinder 14*a* flows out from the gap 14*d.* Water flowing out from the gap 14*d* flows into the reservoir tank 10. Note that because the gap 14*d* is relatively narrow and flow path resistance is high, the pressure inside the cylinder 14*a* rises due to water flowing into the cylinder 14*a* from the inflow pipe 24*a,* such that the piston 14*b* is pushed up in opposition to the bias force of the spring 14*c,* even in a state in which water is flowing out from the gap 14*d.*

In addition, a clutch mechanism 22 is disposed midway along the rod 15. The clutch mechanism 22 is constituted to separate the rod 15 into an upper rod 15*a* and a lower rod 15*b* when the rod 15 (discharge valve 12) is pulled up by a predetermined distance. When the clutch mechanism 22 is separated, the lower rod 15*b* ceases to move in tandem with the upper portion of the piston 14*b* and the upper rod 15*a,* and the lower rod 15*b,* together with the discharge valve 12, drops due to gravity as it resists buoyancy.

A discharge valve float mechanism 26 is disposed close to the discharge valve 12. This discharge valve float mechanism 26 is constituted so that after the rod 15 is pulled up by a predetermined distance and the lower rod 15*b* is detached by the clutch mechanism 22, the lower rod 15*b* and the discharge valve 12 drop, delaying the closing of the discharge opening 10*a.* Specifically, the discharge valve float mechanism 26 has: a float portion 26*a* and a latching portion 26*b* moving in tandem with the float portion 26*a.*

The latching portion 26*b* engages the lower rod 15*b,* which has been separated by the clutch mechanism 22 and has dropped, stopping the lower rod 15*b* and the discharge valve 12 from dropping and seating in the discharge opening 10*a.* Next, the float portion 26*a* drops with the falling water level inside the reservoir tank 10, and when the water level inside the reservoir tank 10 falls to a predetermined water level, the float portion 26*a* causes the latching portion 26*b* to rotate, releasing the engagement between the latching portion 26*b* and the lower rod 15*b.* Release of the engagement allows the lower rod 15*b* and the discharge valve 12 to descend and seat in the discharge opening 10*a.* By this means the closing of the discharge valve 12 is delayed, and an appropriate amount of flush water is discharged from the discharge opening 10*a.*

On the other hand, a generator 16 is placed along the inflow pipe 24*a* connecting the water supply control device 18 and the discharge valve hydraulic drive portion 14, and is constituted to generate electrical power based on the flow of water flowing out from the water supply control device 18 and into the discharge valve hydraulic drive portion 14. Specifically, the generator 16 comprises a water wheel (not shown), and this water wheel is rotationally driven by the flow of water through the inflow pipe 24*a,* producing electrical power. Electrical power produced by the generator 16 is sent to a controller 28 connected to the generator 16, charging a capacitor (not shown) built into the controller 28. Note that electrical power produced and stored by one flush of the flush toilet main unit 2 is greater than the electrical power used to operate the electromagnetic valve 20 for a single flush, so that the electrical power used in a flush can be supplied by the generating power of the generator 16. Therefore the flush water tank apparatus 4 of the present embodiment supplies flush water to the flush toilet main unit 2 using its own generated electrical power.

There is also a vacuum breaker 30 disposed on the inflow pipe 24*a* between the water supply control device 18 and the generator 16. When the pressure in the water supply control device 18 side becomes negative, the vacuum breaker 30 causes outside air to be drawn into the inflow pipe 24*a,* preventing a reverse flow of water from the discharge valve hydraulic drive portion 14 side.

Next, the water supply control device 18 controls the supply of water to the discharge valve hydraulic drive portion 14 based on the operation of the electromagnetic valve 20, and controls the supply and shutting off of water to the reservoir tank 10. That is, the water supply control device 18 is connected between the water supply pipe 32, connected to a water utility, and the inflow pipe 24*a,* connected to the discharge valve hydraulic drive portion 14, and controls the supply and shutting off of water supplied to the discharge valve hydraulic drive portion 14 from the water supply pipe 32 based on a command signal from the controller 28. In the present embodiment, the entire amount of water flowing out from the water supply control device 18 passes through the inflow pipe 24*a* to be supplied to the discharge valve hydraulic drive portion 14. A portion of the water supplied to the discharge valve hydraulic drive portion 14 flows out from the gap 14*d* between the inside wall of the through-hole 14*f* of the cylinder 14*a* and rod 15, then flows into the reservoir tank 10. Most of the water supplied to the discharge valve hydraulic drive portion 14 passes through the water supply pipe 24 and flows out from the cylinder 14*a,* and is split in the outflow pipe branching portion 24*c* into a part flowing into the reservoir tank 10 and a part flowing into the flush toilet main unit 2 through the overflow pipe 10*b.*

Note that in the present embodiment a circuit board and a capacitor (neither shown) are built into the controller 28. A rectifier circuit for converting AC from the generator 16 into DC is disposed on the circuit board; the capacitor is charged by DC current from the rectifier circuit, and an electromagnetic valve control circuit disposed on the circuit board is activated by power from the capacitor.

Water supplied from a utility is supplied to the water supply control device 18 through a shut-off valve 32*a* disposed on the outside of the reservoir tank 10, and through a fixed flow valve 32*b* disposed within the reservoir tank 10 on the downstream side of the shut-off valve 32*a*. Shut-off valve 32*a* is provided to shut off the supply of water to the flush water tank apparatus 4 during maintenance or the like, and is normally used in an open-valve state. The fixed flow valve 32*b* is provided in order to cause water supplied from a utility to flow into the water supply control device 18 at a predetermined constant flow, and is constituted so that a constant flow volume of water is supplied to the water supply control device 18 regardless of the installation environment of the flush toilet apparatus 1.

An electromagnetic valve 20 is attached to the water supply control device 18, and the supply of water to the discharge valve hydraulic drive portion 14 from the water supply control device 18 is controlled based on the operation of the electromagnetic valve 20. Specifically, the controller 28 receives a signal from the remote control device 6 or the human presence sensor 8, and the controller 28 sends an electrical signal to the electromagnetic valve 20, thus activating it. The electromagnetic valve 20 is operated by electrical power produced by the generator 16 and stored in a capacitor (not shown) built into the controller 28.

At the same time, a water supply valve float 34 is also attached to the water supply control device 18, and is constituted to set the reservoir water level inside the reservoir tank 10 at a predetermined water level $L_1$. The water supply valve float 34 is disposed inside the reservoir tank 10; it is constituted to rise as the water level in the reservoir tank 10 rises, shutting off the supply of water from the water supply control device 18 to the discharge valve hydraulic drive portion 14 when the water level has risen to a predetermined water level $L_1$.

Next, referring to FIG. 3, we explain the constitution of the water supply control device 18.

As shown in FIG. 3, the water supply control device 18 has: a main body portion 36 to which the water supply pipe 32 and the inflow pipe 24*a* are connected, a main valve body 38 disposed within the main body portion 36, a valve seat 40 on which the main valve body 38 seats, an arm portion 42 rotated by the water supply valve float 34, and a float-side pilot valve 44 moved by the rotation of the arm portion 42.

The electromagnetic valve 20 attached to the water supply control device 18 has: a solenoid coil 46 for producing drive force, a plunger 48 driven by the solenoid coil 46, an electromagnetic valve-side pilot valve 50 attached to the plunger 48, and a coil spring 52 for pushing the electromagnetic valve-side pilot valve 50 onto the main valve body 38 when the valve is closed.

The main body portion 36 is a member on the lower part of which a water supply pipe 32 connecting portion is provided, with an inflow pipe 24*a* connecting portion on one side, and an electromagnetic valve 20 attached on the side opposite to the inflow pipe 24*a*. A valve seat 40 is formed on the inside of the main body portion 36; the valve seat 40 communicates with the inflow pipe 24*a*, which is connected to a connecting portion. In addition, a main valve body 38 is disposed within the main body portion 36 to open and close the valve seat 40; when the valve is open, municipal water flowing in from the water supply pipe 32 passes through the valve seat 40 and flows out to the inflow pipe 24*a*.

The main valve body 38 is an approximately disk-shaped diaphragm type of valve body, and is attached within the main body portion 36 so as to be capable of seating and unseating from the valve seat 40. Also, at the center of the main valve body 38 is a pilot valve opening 38*a*, opened and closed by the pilot valve 50 on the electromagnetic valve side of the electromagnetic valve 20; a bleed hole 38*b* is provided in the rim portion of the main valve body 38. Also, within the main body portion 36, a pressure chamber 36*a* is also formed on the opposite side of the valve seat 40 (left side in FIG. 3) relative to the main valve body 38. That is, the pressure chamber 36*a* is partitioned by the main body portion 36 interior wall surface and the main valve body 38; when pressure inside the main body portion 36 increases, the main valve body 38 is pushed into the valve seat 40 by the pressure and caused to seat on the valve seat 40.

At the same time, the electromagnetic valve 20 is attached to the main body portion 36 facing the valve seat 40, so that the electromagnetic valve-side pilot valve 50 can be caused to advance and retract within the pressure chamber 36*a* in the main body portion 36. That is, the plunger 48 is slidably disposed in the center portion of the electromagnetic valve 20, and a solenoid coil 46 is provided around the plunger 48. The electromagnetic valve-side pilot valve 50 is attached at the end of the plunger 48; the electromagnetic valve-side pilot valve 50 is pushed onto the pilot valve opening 38*a* of the main valve body 38 by the biasing force of the coil spring 52, thereby closing it. Therefore the electromagnetic valve-side pilot valve 50 is normally causes the pilot valve opening 38*a* to close under the biasing force of the coil spring 52. When the solenoid coil 46 is energized, the electromagnetic valve-side pilot valve 50 is pulled apart from the pilot valve opening 38*a* by the electromagnetic force acting between the solenoid coil 46 and the plunger 48, thereby opening the pilot valve opening 38*a*.

In addition, a pressure conduit 36*b* extends upward to the pressure chamber 36*a*, disposed within the main body portion 36, so as to communicate therewith, and a float-side pilot valve opening 44*a* is provided at the top end of the pressure conduit 36*b*. This float-side pilot valve opening 44*a* opens upward, and is opened and closed by the float-side pilot valve 44.

At the same time, the water supply valve float 34 is supported by an arm portion 42, and this arm portion 42 is rotatably supported by a support shaft 42*a*. In addition, the float-side pilot valve 44 is joined to the arm portion 42, so that the float-side pilot valve 44 is moved up and down by the rotary motion of the arm portion 42. The water supply valve float 34 is thus pressed upward when the water level inside the reservoir tank 10 has risen to predetermined water level $L_1$; in conjunction with this, the float-side pilot valve 44 is moved downward, seating on the float-side pilot valve opening 44*a* and thereby closing it. Meanwhile, when flush water in the reservoir tank 10 is discharged and the water level inside the reservoir tank 10 drops, the water supply valve float 34 descends, float-side pilot valve 44 moves upward, and the float-side pilot valve opening 44*a* is opened.

In this constitution, when the water level in the reservoir tank 10 is at predetermined water level $L_1$ and the solenoid coil 46 of the electromagnetic valve 20 is not energized during toilet flush standby, the pilot valve opening 38*a* of the main valve body 38 and the float-side pilot valve opening 44*a* of the main body portion 36 are both in a closed valve state.

Municipal water which has flowed into the main body portion 36 from the water supply pipe 32 flows into the ring-shaped space around valve seat 40, and from there flows into the pressure chamber 36*a* through the bleed hole 38*b* in the main valve body 38. Here, with the pilot valve opening 38*a* of the main valve body 38 placed in a closed state by the electromagnetic valve-side pilot valve 50, and the float-side pilot valve opening 44*a* closed by the float-side pilot valve 44, there is no conduit for municipal water which has flowed into the pressure chamber 36*a* from the bleed hole 38*b* to flow out, so the pressure inside the pressure chamber 36*a* rises. When the pressure inside the pressure chamber 36*a* thus rises, the main valve body 38 is pressed by this pressure toward the valve seat 40 (on the right side in FIG. 3), and the valve seat 40 is closed by the main valve body 38. Note that in a state in which the valve seat 40 is closed during toilet flush standby, the pilot valve opening 38*a* of the main valve body 38 is closed by the biasing force of the coil spring 52, and the float-side pilot valve opening 44*a* is closed by the buoyancy force of the water supply valve float 34, therefore no electrical power is consumed by the electromagnetic valve 20.

On the other hand when the solenoid coil 46 of the electromagnetic valve 20 is energized, the electromagnetic valve-side pilot valve 50 is pulled apart from the pilot valve opening 38*a* by the electromagnetic force acting on the plunger 48, and water in the pressure chamber 36*a* flows out from the pilot valve opening 38*a*, causing the pressure in the pressure chamber 36*a* to drop. The main valve body 38 is thus moved so as be pulled apart from the valve seat 40 (left side in FIG. 3), thereby opening the valve seat 40. When the water level in the reservoir tank 10 drops below predetermined water level $L_1$, the water supply valve float 34 drops and the float-side pilot valve 44 moves upward, thereby opening the float-side pilot valve opening 44*a*. Thus in a state in which either the pilot valve opening 38*a* of the main valve body 38 or the float-side pilot valve opening 44*a* is opened, there is no rise in the pressure within the pressure chamber 36*a*, therefore the valve seat 40 is opened.

Next we explain the operation of a flush water tank apparatus 4 and flush toilet apparatus 1 equipped with same in a first embodiment of the disclosure.

First, as described above, in the toilet flush standby state, the water level in the reservoir tank 10 is at predetermined water level $L_1$, and the solenoid coil 46 of the electromagnetic valve 20 is not energized. In this state, the pilot valve opening 38*a* of the main valve body 38 and the float-side pilot valve opening 44*a* of the main body portion 36 are both in a closed valve state, and the valve seat 40 is closed by the main valve body 38. Next, when a user presses the flush button on the remote control device 6 (FIG. 1), the remote control device 6 transmits a toilet flush command signal to the controller 28 (FIG. 2). Note that in the flush toilet apparatus 1 of the present embodiment, a toilet flush command signal is transmitted to the controller 28 after detection by the human presence sensor 8 (FIG. 1) that a user has separated from the seat, even if a predetermined time has elapsed, without the flush button of the remote control device 6 being pressed.

When a toilet flush command signal is received, the controller 28 energizes the solenoid coil 46 of the electromagnetic valve 20 (FIG. 3) and causes the electromagnetic valve-side pilot valve 50 to be separated from the pilot valve opening 38*a* of the main valve body 38. Pressure inside the pressure chamber 36*a* thus drops and the main valve body 38 separates from valve seat 40, thereby opening the valve seat 40. As a result, municipal water supplied from the water supply pipe 32 to the water supply control device 18 (FIG. 2) flows out from the water supply control device 18 and through the inflow pipe 24*a*, turning a water wheel (not shown) in the generator 16 to produce electrical power. The generated electrical power charges a capacitor (not shown) built into controller 28.

In addition, water flowing within the inflow pipe 24*a* flows into a cylinder 14*a* in the discharge valve hydraulic drive portion 14. Water which has flowed into the cylinder 14*a* pushes up the piston 14*b* against the biasing force of the spring 14*c*. The rod 15, linked to the piston 14*b*, and the discharge valve 12, linked to the rod 15, are thus pulled up, separating the discharge valve 12 from the discharge opening 10*a*. That is, the discharge valve 12 is driven and opened by the supply pressure of municipal water supplied through the water supply pipe 32.

When the discharge valve 12 is opened, flush water (municipal water) stored in the reservoir tank 10 passes through the discharge opening 10*a* to be discharged into the bowl portion 2*a* of the flush toilet main unit 2 to flush the bowl portion 2*a*. When flush water in the reservoir tank 10 is discharged, the water level inside the reservoir tank 10 drops below the predetermined water level $L_1$, therefore the water supply valve float 34 also drops. This causes the arm portion 42 (FIG. 3) to turn, so that the float-side pilot valve 44 separates from the float-side pilot valve opening 44*a* and the float-side pilot valve opening 44*a* is opened.

Note that with the float-side pilot valve opening 44*a* in an open state, the pressure in the pressure chamber 36*a* rises even if the pilot valve opening 38*a* of the main valve body 38 is closed, therefore a state in which the main valve body 38 is separated from the valve seat 40 (the open valve state) can be maintained. For this reason, after the controller energizes the solenoid coil 46 and the main valve body 38 is opened, energizing of the solenoid coil 46 is turned off when a predetermined time has elapsed and the water level inside the reservoir tank 10 drops. The electromagnetic valve-side pilot valve 50 is thus pressed into the pilot valve opening 38*a* by the biasing force of the coil spring 52, but when the water level in the reservoir tank 10 drops, the float-side pilot valve opening 44*a* is opened, and the main valve body 38 remains separated from the valve seat 40. That is, the controller 28 is able to open the main valve body 38 with just a short duration energization of the solenoid coil 46, so that a single toilet flush can be executed with very low power consumption.

On the other hand when water flows from the inflow pipe 24*a* into the cylinder 14*a* of the discharge valve hydraulic drive portion 14, and the piston 14*b* is pushed up to the upper portion of the cylinder 14*a*, the water in the cylinder 14*a* flows out through the outflow pipe 24*b*. Water which has flowed out through the outflow pipe 24*b* branches at the outflow pipe branching portion 24*c* and respectively flows into the reservoir tank 10 and the overflow pipe 10*b*. A portion of water flowing into the cylinder 14*a* from the inflow pipe 24*a* flows out from the gap 14*d* between the inner wall of the through-hole 14*f* of the cylinder 14*a* and rod 15; this water then flows into the reservoir tank 10.

When the piston 14*b* is pushed up and the rod 15 and the discharge valve 12 are thereby pulled up to a predetermined position, the clutch mechanism 22 separates the lower rod 15*b* and the discharge valve 12 from the upper rod 15*a*. The upper rod 15*a* thus remains pushed upward together with the piston 14*b*, whereas the lower rod 15*b* and the discharge valve 12 drop due to their own weight. However the separated lower rod 15*b* engages with the latching portion 26*b* of the discharge valve float mechanism 26, stopping the descent of the lower rod 15*b* and the discharge valve 12. The discharge opening 10*a* of the reservoir tank 10 is thus left open, and discharging of water from the reservoir tank 10 continues.

The float portion 26*a* of the discharge valve float mechanism 26 drops when the water level inside the reservoir tank 10 drops to a second predetermined water level $L_2$ below predetermined water level $L_1$, causing the latching portion 26*b* to move. This results in a release of the engagement between the lower rod 15*b* and the latching portion 26*b*, so that the lower rod 15*b* and the discharge valve 12 again start to descend. The discharge valve 12 then causes the discharge opening 10*a* of the reservoir tank 10 to close, thus stopping the discharge of flush water to the flush toilet main unit 2. The valve seat 40 inside the water supply control device 18 is still in an open state even after the discharge opening 10*a* is closed, so water supplied from the water supply pipe 32 flows into the discharge valve hydraulic drive portion 14, and water flowing out from the discharge valve hydraulic drive portion 14 passes through the outflow pipe 24*b* to flow into the reservoir tank 10, such that the water level in the reservoir tank 10 rises.

When the water level in the reservoir tank 10 rises to predetermined water level $L_1$, the water supply valve float 34 rises and the float-side pilot valve 44 is lowered by the arm portion 42, thereby opening the float-side pilot valve opening 44*a*. The float-side pilot valve opening 44*a* and the pilot valve opening 38*a* of the main valve body 38 are thus closed, therefore pressure in the pressure chamber 36*a* rises so that the main valve body 38 seats in the valve seat 40. As a result, the supply of water from the water supply control device 18 to the discharge valve hydraulic drive portion 14 is stopped, and generation of electrical power by the generator 16 ends. The piston 14*b* of the discharge valve hydraulic drive portion 14 is pushed down by the biasing force of the spring 14*c*. The upper rod 15*a* and the lower rod 15*b*, which had been separated by the clutch mechanism 22, are again joined when the upper rod 15*a* is pushed down together with the piston 14*b*. Therefore the next time a toilet flush is executed, the upper rod 15*a* and the lower rod 15*b* are both pulled up by the piston 14*b*. As a result of the above, the flush toilet apparatus 1 is restored to a toilet flush standby state when a toilet flush is completed.

Using the flush water tank apparatus 4 of the first embodiment of the disclosure, water is supplied to the discharge valve hydraulic drive portion 14 by the water supply control device 18 based on the operation of the electromagnetic valve 20, and the discharge valve hydraulic drive portion 14 drives a discharge valve utilizing the supply pressure force of supplied municipal water. Therefore the discharge valve 12 can be driven simply by operating the electromagnetic valve 20 using a small electrical power, and flush water in the reservoir tank 10 to discharge flush water in the reservoir tank to the flush toilet main body 2. Also, in the present embodiment electrical power generated by the generator 16 is utilized to operate the electromagnetic valve 20, and the discharge valve 12 is driven based on this, therefore the electrical power requirement can be met by electrical power produced by the generator 16 to control water discharge. The flush water tank apparatus 4 of the present disclosure can therefore be installed even in environments where no external power source is available, and maintenance such as changing batteries can be minimized.

In the flush water tank apparatus 4 of the present embodiment, a generator 16 is provided on the inflow pipe 24*a*, generating electricity by the flow of water in this flow path. Therefore the electromagnetic valve 20 can activated and electricity generated at the timing at which water flows in the water supply pipe 24. Electricity is thus generated each time power is consumed by the operation of the electromagnetic valve 20, and electrical power to operate the electromagnetic valve 20 can be reliably secured without shortages of electrical power.

In addition, in the flush water tank apparatus 4 of the present embodiment a generator 16 is provided on the inflow pipe 24*a*, therefore electricity is generated each time electrical power is consumed by the operation of the electromagnetic valve 20, and consumed electrical power can be more quickly replenished so that the electrical power to operate the electromagnetic valve 20 can be reliably secured without shortages of electrical power.

Also, in the flush water tank apparatus 4 of the present embodiment, a generator 16 is provided on the inflow pipe 24*a* which conducts water from the water supply control device 18 to the discharge valve hydraulic drive portion 14, and water directed from the water supply control device 18 to the discharge valve hydraulic drive portion 14 is supplied to the reservoir tank 10. As a result, all the water supplied to the reservoir tank 10 can contribute to electrical generation, so that more electrical power can be produced.

In addition, in the flush water tank apparatus 4 of the present embodiment a gap 14*d* is provided between the rod 15 projecting from the cylinder 14*a* and the inside wall of the through-hole 14*f*, so debris intrusion between the cylinder 14*a* and the rod 15 can be prevented, and the rod 15 can be smoothly moved. Also, because the generator 16 is provided on the inflow pipe 24*a* which directs water from the water supply control device 18 to the discharge valve hydraulic drive portion 14, there is no decrease in the amount of water contributing to generation even when water flows out from the gap between the inside wall of cylinder 14*a* through-hole 14*f* and the rod 15 in the discharge valve hydraulic drive portion 14, so a sufficient amount of generation can be assured.

Various changes can also be made to the above-described first embodiment flush water tank apparatus 4 of the disclosure. For example, in the flush water tank apparatus 4 of the present embodiment, a clutch mechanism 22 was provided between the piston 14*b* and the discharge valve 12, but it is also possible to omit the clutch mechanism 22. In such cases it is desirable to connect the outflow pipe 24*b* connected to the cylinder 14*a* to the bottom of cylinder 14*a* and provide an opening and closing mechanism for opening and closing the inlet on the outflow pipe 24*b*. In the flush water tank apparatus 4 of the present embodiment, the float-side pilot valve 44 was driven based on the movement of the float 34. In contrast, the disclosure may also be constituted so that in a variant example a water level sensor is provided in place of the float 34, and the pilot valve is controlled by this electromagnetic valve based on a detection signal from this water level sensor. In this case, an electromagnetic valve controlled based on a detection signal from the water level sensor can be provided separately from the electromagnetic valve 20, which is controlled by a control signal from controller 28. Alternatively, a constitution may be adopted in which the electromagnetic valve 20 is controlled by a control signal from the controller 28 and a detection sensor from a water level sensor.

Figure 4:
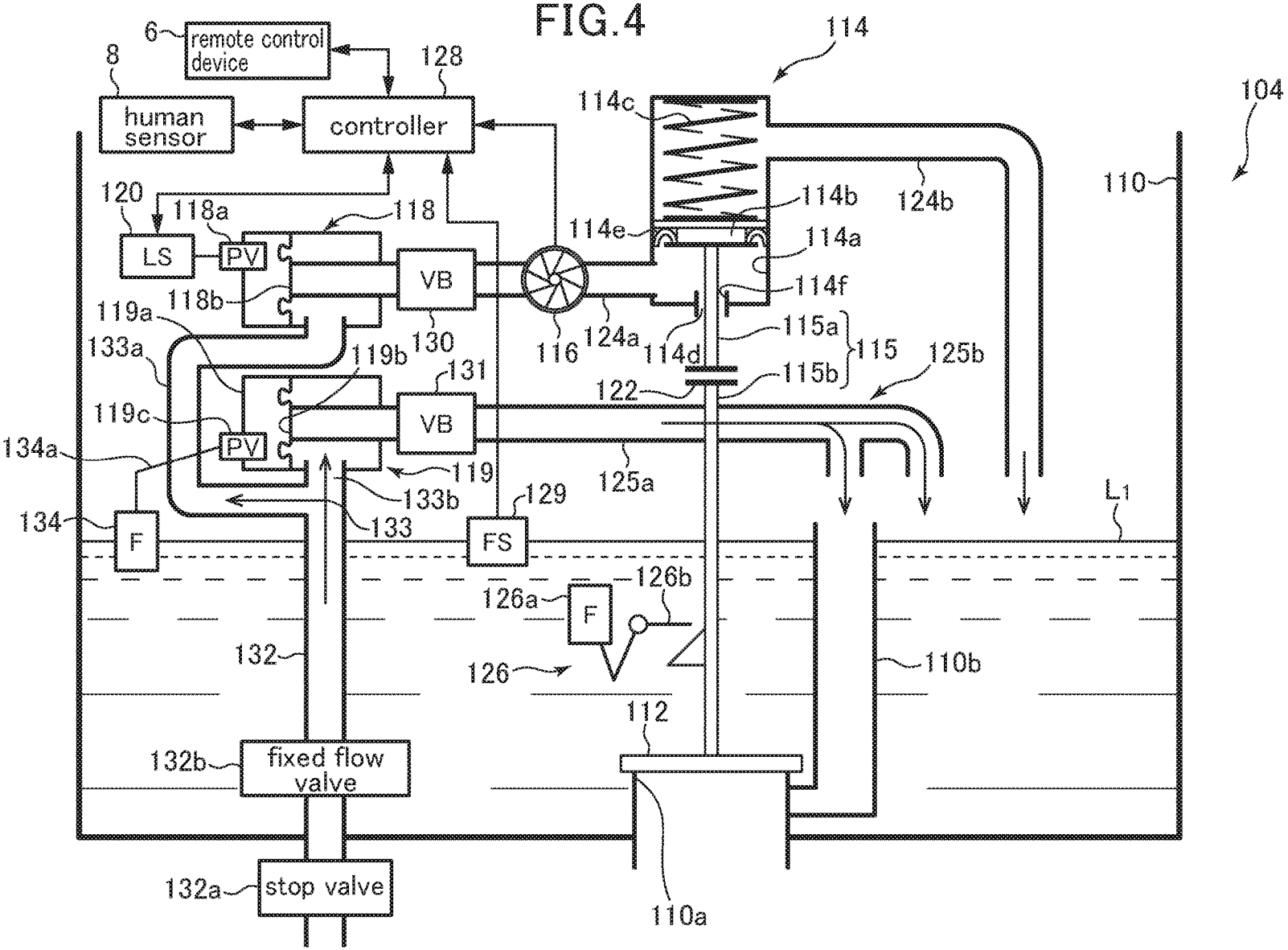
FIG. 4 is a cross section showing the constitution of a flush water tank apparatus according to a second embodiment of the present disclosure.

Next, referring to FIG. 4, we explain a flush water tank apparatus and flush toilet apparatus equipped with same according to a second embodiment of the disclosure.

In the flush water tank apparatus of the present embodiment, the water supply control device has two main valve bodies, which differs from the above-described first embodiment in that the supply of water to the discharge valve hydraulic drive portion and the supply of water into the reservoir tank are performed by separate systems. Therefore here we explain only the portions of the second embodiment of the disclosure which differ from the first embodiment, and we omit explanation of similar constitutions, operations, and effects. FIG. 4 is a cross section showing the constitution of a flush water tank apparatus according to a second embodiment of the present disclosure.

As shown in FIG. 4, a flush water tank apparatus 104 according to a second embodiment of the disclosure includes: a reservoir tank 110 for storing flush water supplied to the flush toilet main unit 2, which is a flush toilet, a discharge valve 112 for opening and closing a discharge opening 110*a* disposed on the reservoir tank 110, and a discharge valve hydraulic drive portion 114 for driving the discharge valve 112. In addition, the flush water tank apparatus 104 includes: a generator 116 placed on the water conduit for supplying water to the discharge valve hydraulic drive portion 114, a discharge control valve 118, primarily for controlling the supply of water to the discharge valve hydraulic drive portion 114, and an electromagnetic valve 120, attached to the discharge control valve 118, operated with electrical power produced by the generator 116. The flush water tank apparatus 104 also has a water supply control valve 119, primarily for controlling the supply of water to the reservoir tank 110. The generator 116, the discharge valve hydraulic drive portion 114, the discharge control device 118, the water supply control valve 119 and the electromagnetic valve 120 are located inside the reservoir tank 110.

The reservoir tank 110 is constituted to store flush water for supply to the flush toilet main unit 2; a discharge opening 10*a* is formed on the bottom portion thereof. An overflow pipe 110*b* is connected on the downstream side of the discharge opening 110*a*, and extends above the water level of flush water stored inside the reservoir tank 110. The discharge valve 112 is a valve body disposed so as to open and close the discharge opening 110*a;* flush water is discharged to the flush toilet main unit 2 by pulling this upward vertically by the discharge valve hydraulic drive portion 114, thereby flushing the bowl portion 2*a*. The discharge valve 112 operates vertically within a casing (not shown).

The discharge valve hydraulic drive portion 114 is constituted to drive the discharge valve 112 using the supply water pressure of flush water supplied from a water utility. Specifically, the discharge valve hydraulic drive portion 114 has a cylinder 114*a* into which water supplied through the discharge control valve 118 flows, a piston 114*b,* and a rod 115 driving the discharge valve 112. In addition, a spring 114*c* is disposed on the interior of the cylinder 114*a;* this biases the piston 114*b* downward, while at the same time a packing 114*e* is attached to the piston 114*b* so that watertightness between the interior wall surface of the cylinder 114*a* and the piston 114*b* is assured. A clutch mechanism 122 is disposed midway along the rod 115; the rod 115 is separated into an upper rod 115*a* and a lower rod 115*b* by means of this clutch mechanism 122.

The cylinder 114*a* is a cylindrical member; it slidably accepts the piston 114*b*, and an inflow pipe 124*a* serving as a drive portion water supply conduit is connected to the bottom end thereof. The cylinder 114*a* is mounted on the casing (not shown) of the discharge valve 112. Water flowing out from the discharge control valve 118 flows into the cylinder 114*a,* and the piston 114*b* is pushed up against the biasing force of the spring 114*c* by the water flowing into the cylinder 114*a*.

An outflow pipe 124*b* serving as a drive portion discharge conduit is connected to the top end of the cylinder 114*a*. In a state whereby the piston 114*b* is pushed up above the connecting portion with the outflow pipe 124*b,* water flowing into the cylinder 114*a* flows out through the outflow pipe 124*b*. The outflow pipe 124*b* extends downward from the cylinder 114*a* and causes water to flow into the reservoir tank 110. Therefore the entire amount of water which has flowed out from the cylinder 114*a* is stored in the reservoir tank 110.

The rod 115 is connected to the under surface of the piston 114*b* and extends through the through-hole 114*f* formed in the bottom of the cylinder 114*a* to project downward from the middle of the cylinder 14*a;* the bottom end thereof is connected to the discharge valve 112. Therefore when the piston 114*b* is pushed up, the rod 115 pulls the discharge valve 112 upward, opening the discharge valve 112.

A gap 114*d* is disposed between the rod 115 projecting from beneath the cylinder 114*a* and the inside wall of the through-hole 114*f* in the cylinder 114*a;* a portion of water flowing into the cylinder 114*a* flows out from the gap 114*d*. Water flowing out from the gap 114*d* flows into the reservoir tank 110. In addition, a clutch mechanism 122 is provided along the rod 115; by this means, when the rod 115 (discharge valve 112) has been pulled up by a predetermined distance, the rod 115 is separated in to an upper rod 115*a* and a lower rod 115*b*.

A discharge valve float mechanism 126 is provided close to the discharge valve 112. The discharge valve float mechanism 126 is constituted so that after the rod 115 has been pulled up a predetermined distance and the lower rod 115*b* has been separated by the clutch mechanism 122, the lower rod 115*b* and the discharge valve 112 descend, thereby delaying the closing of the discharge opening 110*a*. More specifically, the discharge valve float mechanism 126 has a float portion 126*a,* and an latching portion 126*b* which moves in tandem with the float portion 126*a*.

The latching portion 126*b* is constituted to engage with the lower rod 115*b*, which has been separated by the clutch mechanism 122 and has descended, thereby preventing the lower rod 115*b* and the discharge valve 112 from descending and seating in the discharge opening 110*a*. Next, when the water level in the reservoir tank 110 descends to a predetermined water level, the float portion 126*a* rotates the latching portion 126*b,* releasing the engagement. Release of the engagement allows the lower rod 115*b* and the discharge valve 112 to descend and seat in the discharge opening 110*a*. Thus the closing of the discharge valve 112 is delayed, and an appropriate amount of flush water is discharged from the discharge opening 110*a*.

At the same time, the generator 16 is placed along the inflow pipe 124*a,* which connects the discharge control valve 118 and the discharge valve hydraulic drive portion 114, and electricity is generated based on the flow of water. Electrical power generated by the generator 116 is fed to the controller 128 connected to the generator 116 and used to charge a capacitor (not shown) built into the controller 128. Also, a vacuum breaker 130 is provided on the inflow pipe 124*a* between the discharge control valve 118 and the generator 116. In addition, a float switch 129 is connected to the controller 128; the float switch 129 is disposed inside the reservoir tank 110 and senses that the water level inside the reservoir tank 110 has reached a predetermined water level $L_1$.

Next, the water supply control device 118 is constituted to control the supply of water to the discharge valve hydraulic drive portion 114, based on the activation of the electromagnetic valve 120. That is, the discharge control valve 118 is connected from water utility-connected water supply pipe 132 to a first branch pipe 133*a,* which branches in the water supply pipe branching portion 133. The discharge control valve 118 is connected to the downstream side of the first branch pipe 133*a* and controls the supplying and shutting off of water flowing in from the first branch pipe 133*a* to the discharge valve hydraulic drive portion 114, based on a command signal from the controller 128. In the present embodiment, a portion of the water supplied to the discharge valve hydraulic drive portion 114 flows out from the gap 144*d* between the inside wall of the cylinder 114*a* through-hole 114*f* and the rod 115, and into the reservoir tank 110. The majority of water supplied to the discharge valve hydraulic drive portion 114 flows out from the cylinder 114*a* through the outflow pipe 124*b* and into the reservoir tank 110.

Water supplied from a utility pipe passes through the stopcock 132*a* disposed on the outside of the reservoir tank 110, and the fixed flow valve 132*b* on the downstream side of the stopcock 132*a,* to reach the water supply pipe branching portion 133, and is supplied to the discharge control valve 118 from a first branch pipe 133*a* which branches at the water supply pipe branching portion 133.

An electromagnetic valve 120 is attached to the discharge control valve 118, and the supply of water from the discharge control valve 118 to the discharge valve hydraulic drive portion 114 is controlled based on the operation of the electromagnetic valve 120. Specifically, the controller 128 receives a signal from the remote control device 6 or the human presence sensor 8, and the controller 128 sends an electrical signal to the electromagnetic valve 120, thus activating it. The electromagnetic valve 120 is operated by electrical power produced by the generator 116 and stored in a capacitor (not shown) built into the controller 128.

That is, the electromagnetic valve 120 is constituted to move the electromagnetic valve-side pilot valve 118*a* built into the discharge control valve 118, based on a signal transmitted from the controller 128, thereby opening and closing the pilot valve opening in the main valve body 118*b* of the discharge control valve 118. By so doing, the main valve body 118*b* of the discharge control valve 118 is opened and closed based on the operation of the electromagnetic valve 120 to control the supply and shut off of water to the discharge valve hydraulic drive portion 114. Note that in the present embodiment a bi-stable latching solenoid is used for the electromagnetic valve 120, which is temporarily energized to move the electromagnetic valve-side pilot valve 118*a,* and which is then kept in that state even when energization is turned off. In an electromagnetic valve 120 of this type, the electromagnetic valve-side pilot valve 118*a* can be restored to its original position by again applying energy in the opposite direction.

In the meanwhile, a second branched pipe 133*b,* which is branched at the water supply pipe branching portion 133, is connected to the water supply control valve 119. The water supply control valve 119 is constituted to cause water supplied from the second branched pipe 133*b* to flow out to the tank supply pipe 125*a*. Water which has flowed into the tank supply pipe 125*a* is branched into two parts in the tank supply pipe branching portion 125*b;* one part flows into the reservoir tank 110, the other into the overflow pipe 110*b*. Therefore in the present embodiment the discharge control valve 118 and the water supply control valve 119 control the supply of water to the discharge valve hydraulic drive portion 114 based on the operation of the electromagnetic valve 120, and function as a water supply control device for controlling the supply and shutting off of water to the reservoir tank 110. A vacuum breaker 131 is provided between the water supply control valve 119 and the tank supply pipe branching portion 125*b*. A reverse flow of water into the water supply pipe 132 from the tank supply pipe 125*a* side when the second branched pipe 133*b* goes to a negative pressure can thus be prevented.

The water supply control valve 119 comprises a water supply valve main unit 119*a,* a main valve body 119*b* disposed in the middle of the water supply valve main unit 119*a,* and a float-side pilot valve 119*c*. A water supply valve float 134 is connected to the water supply control valve 119, and the float-side pilot valve 119*c* is moved in response to movement of the water supply valve float 134. That is, the float-side pilot valve 119*c* is constituted so as to control the pressure inside a pressure chamber placed within the water supply valve main unit 119*a* by opening and closing a pilot valve opening (not shown) provided on the water supply valve main unit 119*a*.

The water supply valve float 134 is disposed inside the reservoir tank 110; it rises together with a rise in water level within the reservoir tank 110, thereby moving the float-side pilot valve 119*c* through the arm portion 134*a*. When the water level inside the reservoir tank 110 rises to predetermined water level $L_1$, the float-side pilot valve 119*c* closes the pilot valve opening (not shown) on the water supply valve main unit 119*a*. When the pilot valve opening is closed, pressure in the pressure chamber inside the water supply valve main unit 119*a* rises, the main valve body 119*b* is moved, and the water supply control valve 119 is closed.

Next we explain the operation of the flush water tank apparatus 104 and a flush toilet apparatus equipped with same according to a second embodiment of the disclosure.

First, in the toilet flush standby state, the water level of water in the reservoir tank 110 is at predetermined water level $L_1$, and the electromagnetic valve 120 is not energized. In this state, the pilot valve opening on the main valve body 118*b* of the discharge control valve 118 is in a closed state, and the discharge control valve 118 is closed. The water supply control valve 119 main valve body 119*b* pilot valve opening is also in a closed state, and the water supply control valve 119 is also closed. Next, when a user presses the flush button on the remote control device 6 (FIG. 1), the remote control device 6 transmits a toilet flush command signal to the controller 128 (FIG. 4).

When a toilet flush command signal is received, the controller 128 energizes the electromagnetic valve 120 to unseat the electromagnetic valve-side pilot valve 118*a* from the pilot valve opening on the main valve body 118*b*. This causes pressure in the pressure chamber of the discharge control valve 118 to drop, unseating the main valve body 118*b* from the valve seat so that it is opened. In the present embodiment a bistable latching solenoid is used as the electromagnetic valve 120, therefore once the electromagnetic valve-side pilot valve 118*a* is opened, and that open state is maintained even if energization is turned off. When the discharge control valve 118 is closed, municipal water supplied from the water supply pipe 132 through the water supply pipe branching portion 133 and the first branch pipe 133*a* to the discharge control valve 118 flows through the discharge control valve 118 into the inflow pipe 124*a,* rotating the water wheel (not shown) of the generator 116 to generate electrical power. Generated electrical power is used to charge the capacitor (not shown) built into the controller 128.

In addition, water flowing in the inflow pipe 124*a* flows into the cylinder 114*a* of the discharge valve hydraulic drive portion 114 and pushes up the piston 114*b*. This results in the lifting up of both the rod 115 and the discharge valve 112 connected to the piston 114*b;* discharge opening 110*a* is closed, and the bowl portion 2*a* of the flush toilet main unit 2 is flushed.

When flush water in the reservoir tank 110 is discharged, the water level in the reservoir tank 110 drops to below predetermined water level $L_1$, so the water supply valve float 134 descends. This causes the arm portion 134*a* to rotate, unseating the float-side pilot valve 119*c* from the pilot valve opening on the main valve body 119*b* and opening the pilot valve opening. As a result, pressure in the pressure chamber in the water supply control valve 119 water supply valve main unit 119*a* drops, and the main valve body 119*b* unseats from the valve seat. When the water supply control valve 119 opens, municipal water supplied from the water supply pipe 132 through the water supply pipe branching portion 133 and the second branched pipe 133*b* to the water supply control valve 119 passes through the water supply control valve 119 to flow into the tank supply pipe 125*a*. Water which has flowed into the tank supply pipe 125*a* is branched in the tank supply pipe branching portion 125*b*; one part flows into the overflow pipe 110*b*, while the remainder flows into the reservoir tank 110.

Meanwhile, when water flows from the inflow pipe 124*a* into the cylinder 114*a* of the discharge valve hydraulic drive portion 114, pushing up the piston 114*b* to the upper portion of the cylinder 114*a*, the water inside the cylinder 114*a* flows out through the outflow pipe 124*b*. Water flowing out through the outflow pipe 124*b* flows into the reservoir tank 110. A portion of water flowing into the cylinder 114*a* from the inflow pipe 124*a* flows out from the gap 144*d* between the inside wall of through-hole 114*f* in the cylinder 114*a* and the rod 115; this water flows into the reservoir tank 110.

When the piston 114*b* is pushed up and the rod 115 and the discharge valve 112 are thereby pulled up to a predetermined position, the clutch mechanism 122 separates the lower rod 115*b* and the discharge valve 112 from the upper rod 115*a*. As a result, the upper rod 115*a* is pushed upward together with the piston 114*b*, while the lower rod 115*b* and the discharge valve 112 descend under their own weight. However, the separated lower rod 115*b* engages the latching portion 126*b* of the discharge valve float mechanism 126, stopping the descent of lower rod 115*b* and discharge valve 112. Thus the discharge opening 110*a* of the reservoir tank 110 remains open, and the discharge of water from the reservoir tank 110 is continued.

Here, when the water level in the reservoir tank 110 drops to a second predetermined water level $L_2$ below predetermined water level $L_1$, the float portion 126*a* of the discharge valve float mechanism 126 descends, moving the latching portion 126*b*. Engagement between the lower rod 115*b* and the latching portion 126*b* is thus released, and the lower rod 115*b* and the discharge valve 112 again start to descend. Thereafter, the discharge valve 112 causes the discharge opening 110*a* of the reservoir tank 110 to close, stopping the discharge of flush water to the flush toilet main unit 2. Even after the discharge opening 110*a* is closed, the discharge control valve 118 and the water supply control valve 119 are in an open valve state, so that water supplied from the water supply pipe 132 flows into the discharge valve hydraulic drive portion 114, and water flowing out from the discharge valve hydraulic drive portion 114 flows into the reservoir tank 110 through the outflow pipe 124*b*, and water passing through the water supply control valve 119 passes through the tank supply pipe 125*a* and into the reservoir tank 110, therefore the water level in the reservoir tank 110 rises.

When the water level in the reservoir tank 110 rises to predetermined water level $L_1$, the water supply valve float 134 rises, the float-side pilot valve 119*c* is moved, mediated by the arm portion 134*a*, and the pilot valve opening is closed. The pressure in the pressure chamber within the water supply valve main unit 119*a* thus rises, closing the main valve body 119*b*, and the water supply control valve 119 enters a valve-closed state. When the water level inside the reservoir tank 110 rises to predetermined water level $L_1$, the float switch 129 detects this and sends a signal to the controller 128. When the controller 128 senses by the float switch 129 that the water level in the reservoir tank 110 has reached predetermined water level $L_1$, the electromagnetic valve 120 is again energized. Thus the electromagnetic valve 120 moves the electromagnetic valve-side pilot valve 118*a* toward the main valve body 118*b* of the discharge control valve 118, closing the pilot valve opening of the main valve body 118*b*. As a result, the pressure in the pressure chamber within the discharge control valve 118 rises, and the discharge control valve 118 is placed in a closed valve state. The supply of water to the reservoir tank 110 is thus shut off.

When the discharge control valve 118 is closed, the supply of water from the discharge control valve 118 to the discharge valve hydraulic drive portion 114 is stopped, and generation of electrical power by the generator 116 terminates. The piston 114*b* of the discharge valve hydraulic drive portion 114 is pushed down by the biasing force of the spring 114*c*. The upper rod 115*a* and the lower rod 115*b*, which had been separated by the clutch mechanism 122, are again joined when the upper rod 115*a* is pushed down together with the piston 114*b*. Therefore when a toilet flush is next flushed, the upper rod 115*a* and the lower rod 115*b* will both be pulled up by the piston 114*b*. By the above means, a single toilet flush is completed and the flush toilet apparatus returns to a toilet flush standby state.

In the flush toilet apparatus of a second embodiment of the disclosure, the discharge control valve and the supply control valve which function as a supply control device respectively comprise individual main valve bodies. Therefore simply adding the discharge control valve 118, the generator 116, and the discharge valve hydraulic drive portion 114 to a flush water tank comprising a conventional water supply control valve controlled by a float enables the constitution of a flush water tank apparatus for supplying flush water to a flush toilet using self-generated electrical power.

Figure 5:
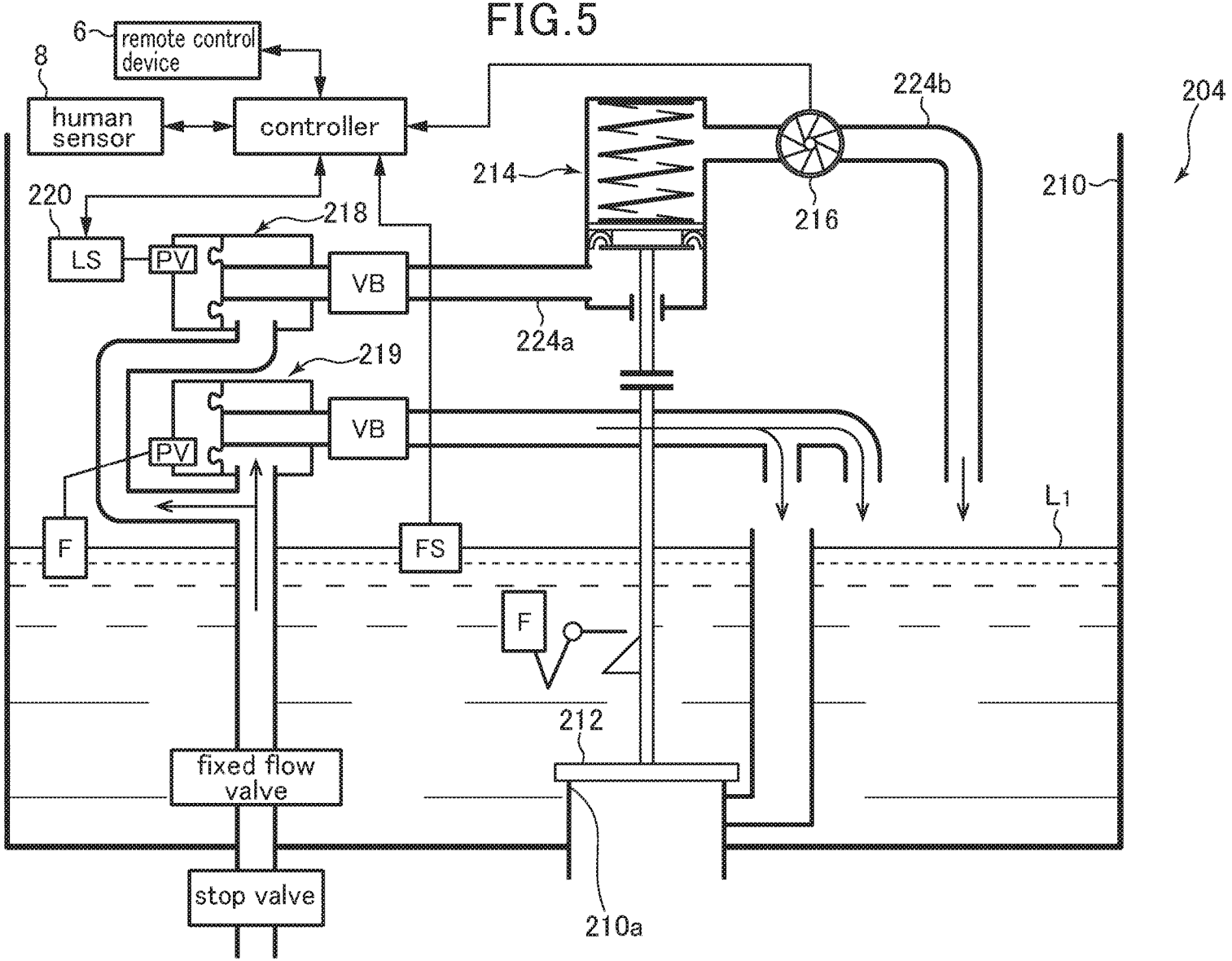
FIG. 5 is a cross section showing the constitution of a flush water tank apparatus according to a third embodiment of the present disclosure.

Next, referring to FIG. 5, we explain a flush water tank apparatus and flush toilet apparatus equipped with same according to a third embodiment of the disclosure.

The flush toilet apparatus of the present embodiment differs from the above-described second embodiment in that the generator is disposed on the outflow pipe rather than the inflow pipe. Therefore here we explain only the portions of the third embodiment of the disclosure which differ from the second embodiment, and we omit explanation of similar constitutions, operations, and effects.

As shown in FIG. 5, a flush water tank apparatus 204 according to a third embodiment of the disclosure includes: a reservoir tank 210 for storing flush water supplied to the flush toilet main unit 2, which is a flush toilet, a discharge valve 212 for opening and closing a discharge opening 210*a* disposed on the reservoir tank 210, and a discharge valve hydraulic drive portion 214 for driving the discharge valve 212. In addition, the flush tank apparatus 204 includes: a generator 216 provided on the outflow pipe 224*b*, which is a drive portion discharge conduit for discharging water from the discharge valve hydraulic drive portion 214, a discharge control valve 218 for controlling the supply of water to the discharge valve hydraulic drive portion 214, and an electromagnetic valve 220, attached to the discharge control valve 218, which operates using electrical power generated by the generator 216. Water flowing out from the discharge control valve 218 passes through the inflow pipe 224*a*, which serves as a drive portion water supply conduit, and is supplied to the discharge valve hydraulic drive portion 214.

Also, the flush water tank apparatus 204 includes a water supply control valve 219, primarily for controlling the supply of water to the reservoir tank 210. Therefore in the present embodiment the discharge control valve 218 and the water supply control valve 219 function as water supply control devices. The generator 216, the discharge valve hydraulic drive portion 214, the discharge control valve 218, the water supply control valve 219 and the electromagnetic valve 220 are located inside the reservoir tank 210.

In a flush toilet apparatus of a third embodiment of the disclosure, the generator 216 is placed on the outflow pipe 224*b*, which discharges water from the discharge valve hydraulic drive portion 214, therefore the discharge valve hydraulic drive portion 214 can drive the discharge valve 212 without pressure losses caused by the generator 216. Therefore the discharge valve 212 can be robustly driven, and the discharge opening diameter is relatively large for application in the flush toilets requiring a relatively high instantaneous flow rate or the like, so the disclosure may also be applied to the discharge valve 212, which requires a large force for valve opening.

We have explained embodiments of the disclosure above; various changes may be made to the above-described embodiments. For example, in the above-described second and third embodiments, the generator may be placed on the downstream side of the water supply control valve. Or the generator may be placed on the upstream side of the discharge control valve and/or supply control valve.

In the first, second, and third embodiments described above, electrical power generated by the generator was stored in a capacitor built into the controller, but the disclosure may also be constituted so that electrical power is stored in a battery rather than a capacitor. Also, in the above-described embodiments a clutch mechanism was placed between the piston and the discharge valve, but the clutch mechanism may also be omitted. In the above-described embodiments, the piston placed on the discharge valve hydraulic drive portion was vertically driven, but the disclosure may also be constituted so that, for example, the piston is horizontally driven. In such cases a mechanism should be provided to convert the piston movement direction to the direction in which the discharge valve is driven. In addition, in the above-described embodiments a gap was provided between the cylinder bottom surface through-hole and the rod, but is also acceptable to provide watertightness between the through-hole and the rod. Also, the present disclosure can be constituted so that the discharge valve is driven by a mechanism rotated by water supply pressure rather than by a piston in the water supply valve hydraulic drive portion. Moreover, in the above-described embodiments the water supply control device was constituted so that the main valve body was opened and closed by a pilot valve driven by an electromagnetic valve, but the disclosure may also be constituted so that the main valve body is directly opened and closed by an electromagnetic valve.

Figure 6:
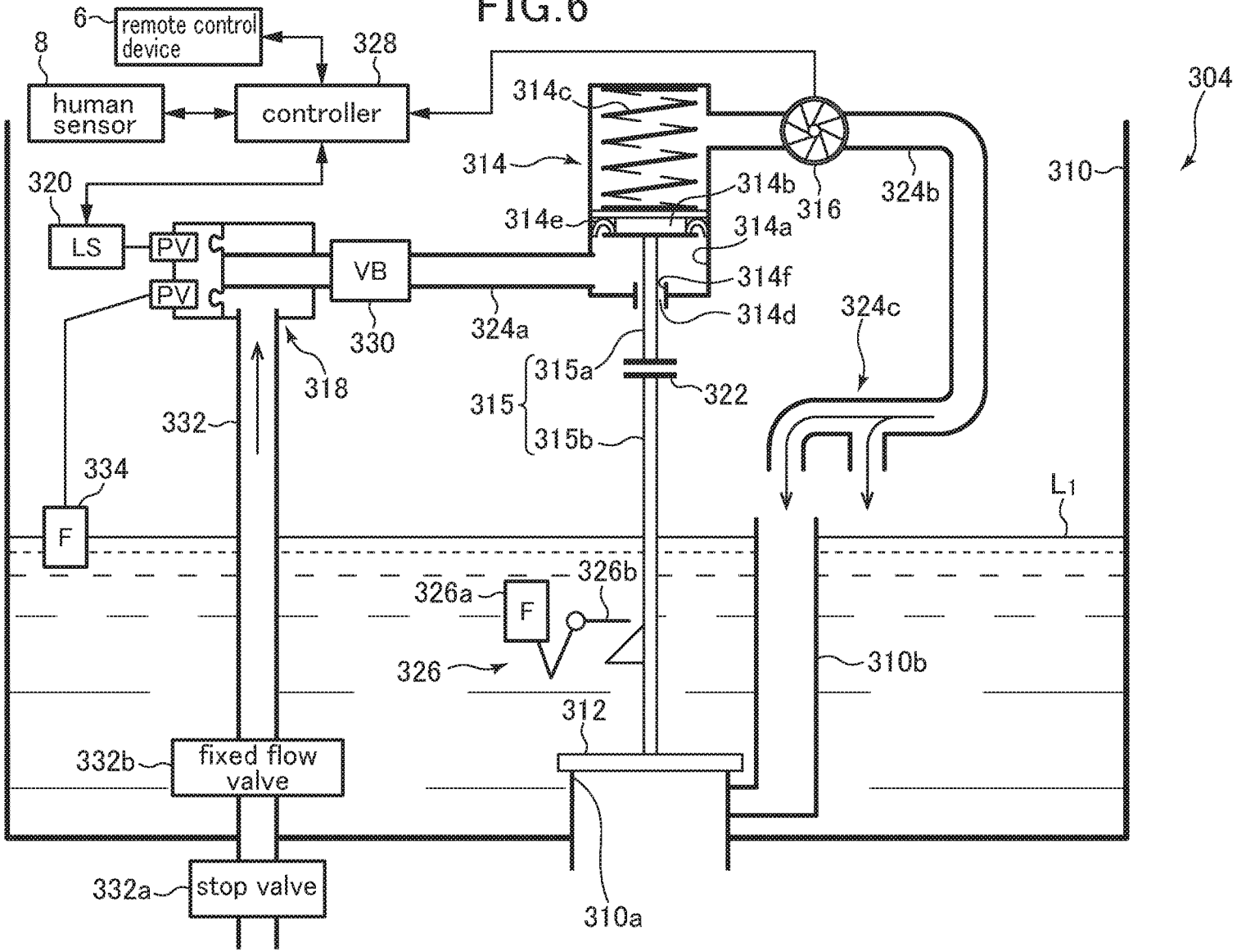
FIG. 6 is a cross section showing the constitution of a flush water tank apparatus according to a fourth embodiment of the present disclosure.

Next, referring to FIG. 6, we explain a flush water tank apparatus and flush toilet apparatus equipped with same according to a fourth embodiment of the disclosure.

The flush toilet apparatus of the present embodiment differs from the above-described first embodiment in that the generator is disposed on the outflow pipe rather than the inflow pipe. Therefore here we explain only the portions of the fourth embodiment of the disclosure which differ from the first embodiment, and we omit explanation of similar constitutions, operations, and effects.

As shown in FIG. 6, the flush water tank apparatus 304 includes: a reservoir tank 310 for storing flush water to be supplied to the flush toilet main unit 2, a discharge valve 312 for opening and closing a discharge opening 310*a* disposed on the reservoir tank 310, and a discharge valve hydraulic drive portion 314 for driving the discharge valve 312. In addition, the flush water tank apparatus 304 includes: a generator 316 placed on a water conduit for discharging water from the discharge valve hydraulic drive portion 314, a discharge control valve 318 for supplying and shutting off water to the discharge valve hydraulic drive portion 314, and an electromagnetic valve 320 which operates by electrical power generated by the generator 316. The generator 316, the discharge valve hydraulic drive portion 314, the discharge control valve 318 and the electromagnetic valve 320 are located inside the reservoir tank 310.

The reservoir tank 310 is a tank constituted to store flush water to be supplied to the flush toilet main unit 2, at the bottom portion of which a discharge opening 310 is formed for discharging stored flush water to the flush toilet main unit 2. Within the reservoir tank 310, an overflow pipe 310*b* is connected on the downstream side of the discharge opening 310*a*. This overflow pipe 310*b* rises vertically near the discharge opening 310*a* and extends above the surface of the flush water stored in reservoir tank 310. Therefore flush water flowing in from the top end of the overflow pipe 310*b* bypasses the discharge opening 310*a* and flows directly out to the flush toilet main unit 2.

The discharge valve 312 is a valve body disposed so as to open and close the discharge opening 310*a;* the discharge valve 312 is opened by being pulled up vertically by the discharge valve hydraulic drive portion 314, so that flush water in the reservoir tank 310 is discharged to the flush toilet main unit 2 and the flush bowl portion 2*a* is flushed. The discharge valve 312 operates vertically within a casing (not shown).

The discharge valve hydraulic drive portion 314 is constituted to drive the discharge valve 312 utilizing the supply water pressure of flush water supplied from a water utility. Specifically, the discharge valve hydraulic drive portion 314 includes: a cylinder 314*a* into which water supplied from the water supply control device 318 flows, a piston 314*b* slidably disposed within the cylinder 314*a*, and a rod 315 projecting from the bottom end of the cylinder 314*a* to drive the discharge valve 312. In addition, a spring 314*c* is disposed on the interior of the cylinder 314*a;* this biases the piston 314*b* downward, and a packing 314*e* is attached to the piston 314*b* to secure watertightness between the interior wall surface of the cylinder 314*a* and the piston 314*b*. A clutch mechanism 322 is disposed midway along the rod 315; the rod 315 is separated into an upper rod 315*a* and a lower rod 315*b* by means of the clutch mechanism 322.

The cylinder 314*a* is a cylindrical member; the axial line thereof is disposed in the vertical direction, and the piston 314*b* is slidably received on the interior thereof. The cylinder 314*a* is mounted on the casing (not shown) of the discharge valve 312. An inflow pipe 324*a* serving as drive portion water supply conduit is attached at the bottom end portion of the cylinder 314*a* so that water flowing out from the water supply control device 318 flows into the cylinder 314*a*. Therefore the piston 314*b* inside the cylinder 314*a* is pushed up in opposition to the biasing force of the spring 314*c* by water flowing into the cylinder 314*a*.

At the same time, an outflow hole is disposed on the top end portion of the cylinder 314*a*, and the outflow pipe 324*b*, which is the drive portion discharge conduit, communicates with the interior of the cylinder 314*a* through the outflow hole. Therefore when water flows into the cylinder 314*a* from the inflow pipe 324*a* connected to the bottom portion of the cylinder 314*a*, the piston 314*b* is pushed up from the bottom portion of the cylinder 314*a*, which is a first position. When the piston 314*b* is pushed up to a second position above the outflow hole, water which has flowed into the cylinder 314*a* flows out from the outflow hole through the outflow pipe 324*b*. That is, the inflow pipe 324*a* and the outflow pipe 324*b* communicate through the interior of the cylinder 314*a* when the piston 314*b* is moved to a second position. An outflow pipe branching portion 324*c* is disposed at the end portion of the outflow pipe 324*b* which extends from the cylinder 314*a*. The outflow pipe 324*b*, which branches in the outflow pipe branching portion 324*c*, on one side causes water in the reservoir tank 310 to flow out, and on the other causes water to flow out into the overflow pipe 310*b*. Therefore a portion of water flowing out from the cylinder 314*a* is discharged through the overflow pipe 310*b* into the flush toilet main unit 2, and the rest is stored in the reservoir tank 310.

The rod 315 is a rod-shaped member connected to the undersurface of the piston 314*b*, which passes through a through-hole 314*f* formed on the bottom of the cylinder 314*a*, and extends so as to project downward from the middle of the cylinder 314*a*. A discharge valve 312 is connected to the bottom end of the rod 315; the rod 315 links the piston 314*b* and the discharge valve 312. Therefore when water flows into the cylinder 314*a*, pushing the piston 314*b* up, the rod 315 connected to the piston 314*b* pulls the discharge valve 312 upward, opening the discharge valve 312.

A gap 314*d* is disposed between the rod 315 projecting from beneath the cylinder 314*a* and the inside wall of the through-hole 314*f* in the cylinder 314*a*; a portion of water flowing into the cylinder 314*a* flows out from the gap 314*d*. Water flowing out from the gap 314*d* flows into the reservoir tank 310. Note that because the gap 314*d* is relatively narrow and flow path resistance is high, the pressure inside the cylinder 314*a* rises due to water flowing into the cylinder 314*a* from the inflow pipe 324*a*, so that the piston 314*b* is pushed up in opposition to the bias force of the spring 314*c*, even in a state where water is flowing out from the gap 134*d*.

In addition, a clutch mechanism 322 is provided midway along the rod 315. The clutch mechanism 322 is constituted to separate the rod 315 into an upper rod 315*a* and a lower rod 315*b* when the rod 315 (discharge valve 312) is pulled up by a predetermined distance. With the clutch mechanism 322 separated, the lower rod 315*b* ceases to move in tandem with the upper portion of the piston 314*b* and the upper rod 315*a*, and the lower rod 315*b* drops, together with the discharge valve 132, due to gravity as it resists buoyancy.

A discharge valve float mechanism 326 is provided close to the discharge valve 312. The discharge valve float mechanism 326 is constituted so that after the rod 315 has been pulled up a predetermined distance and the lower rod 315*b* has been separated by the clutch mechanism 322, the lower rod 315*b* and the discharge valve 312 descend, thereby delaying the closing of the discharge opening 310*a*. Specifically, the discharge valve float mechanism 326 includes: a float portion 326*a*, and an latching portion 326*b* which moves in tandem with the float portion 326*a*.

The latching portion 326*b* is constituted to engage with the lower rod 315*b*, which has been separated by the clutch mechanism 322 and has descended, thereby preventing the lower rod 315*b* and the discharge valve 312 from descending and seating in the discharge opening 310*a*. Next, when the float portion 326*a* drops together with the falling water level inside the reservoir tank 310, and the water level inside the reservoir tank 310 falls to a predetermined water level, the float portion 326*a* causes the latching portion 326*b* to rotate, releasing the engagement between the latching portion 326*b* and the lower rod 315*b*. Release of the engagement allows the lower rod 315*b* and the discharge valve 312 to descend and seat in the discharge opening 310*a*. Thus the closing of the discharge valve 312 is delayed, and an appropriate amount of flush water is discharged from the discharge opening 310*a*.

At the same time, the generator 316 is provided along the outflow pipe 324*b* further down the downstream side than the discharge valve hydraulic drive portion 314, and electrical power is generated based on the flow of water flowing out from the discharge valve hydraulic drive portion 314 up to the outflow pipe branching portion 324*c*. Specifically, the generator 316 comprises a water wheel (not shown), and the water wheel is rotationally driven by the flow of water in the inflow pipe 324*a*, producing electrical power. Electrical power generated by the generator 316 is fed to the controller 328 connected to the generator 316 and used to charge a capacitor (not shown) built into the controller 328. In addition, the electrical power produced and stored by one flush of the flush toilet main unit 2 is greater than the electrical power used to operate the electromagnetic valve 320 for a single flush, therefore the electrical power used in a flush can be supplied by the generating power of the generator 316. Thus the flush water tank apparatus 304 of the present embodiment supplies flush water to flush the toilet main unit 2 using its own generated electrical power.

There is also a vacuum breaker 330 disposed on the inflow pipe 324*a* between the water supply control device 318 and the generator 316. When the pressure in the water supply control device 318 becomes negative, the vacuum breaker 330 causes outside air to be drawn into the inflow pipe 324*a*, preventing a reverse flow of water from the discharge valve hydraulic drive portion 314 side.

Next, the water supply control device 318 controls the supply of water to the discharge valve hydraulic drive portion 314 based on the operation of the electromagnetic valve 320, and controls the supply and shutting off of water to the reservoir tank 310. That is, the water supply control device 318 is connected between the water supply pipe 332 connected to a water utility, and the inflow pipe 324*a* connected to the discharge valve hydraulic drive portion 314, and controls the supply and shutting off of the supply of water to the discharge valve hydraulic drive portion 314 from the water supply pipe 332 based on a command signal from the controller 328. In the present embodiment, the entire amount of water flowing out from the water supply control device 318 passes through the inflow pipe 324*a* and is supplied to the discharge valve hydraulic drive portion 314. A portion of the water supplied to the discharge valve hydraulic drive portion 314 flows out from the gap 314*d* between the inside wall of cylinder 314*a* through-hole 314*f* and the rod 315, then flows into the reservoir tank 310. Most of the water supplied to the discharge valve hydraulic drive portion 314 passes through the water supply pipe 324 and flows out from the cylinder 314*a*, and is split in the outflow pipe branching portion 324*c* into a part that flows into the reservoir tank 310 and a part that flows into the flush toilet main unit 2 through the overflow pipe 310*b*.

Note that in the present embodiment a circuit board and a capacitor (neither shown) are built into the controller 328. A rectifier circuit for converting AC from the generator 316 into DC is disposed on the circuit board; the capacitor is charged by DC current from the rectifier circuit, and an electromagnetic valve control circuit disposed on top of the circuit board is activated by power from the capacitor.

Water supplied from a utility is supplied to the water supply control device 318 through a shut-off valve 332*a* disposed on the outside of the reservoir tank 310 and a fixed flow valve 332*b* disposed within the reservoir tank 310 on the downstream side of the shut-off valve 332*a*. The shut-off valve 332*a* is provided to shut off the supply of water to the flush water tank apparatus 304 during maintenance or the like, and is normally used in an open-valve state. The fixed flow valve 332*b* is provided in order to cause water supplied from a utility to flow into the water supply control device 318 at a predetermined constant flow, and is constituted so that a constant flow volume of water is supplied to the water supply control device 318 regardless of the installation environment of the flush toilet apparatus 1.

An electromagnetic valve 320 is attached to the discharge control valve 318, and the supply of water from the discharge control valve 318 to the discharge valve hydraulic drive portion 314 is controlled based on the operation of the electromagnetic valve 320. Specifically, the controller 328 receives a signal from the remote control device 6 or the human presence sensor 8, and the controller 328 sends an electrical signal to the electromagnetic valve 320, thus activating it. The electromagnetic valve 320 is operated by electrical power produced by the generator 316 and stored in a capacitor (not shown) built into the controller 328.

At the same time, a water supply valve float 334 is also attached to the water supply control device 318, and is constituted to set the reservoir water level inside the reservoir tank 310 at a predetermined water level $L_1$. The water supply valve float 334 is disposed inside the reservoir tank 310; it is constituted to rise with the rise in the reservoir tank 310 water level, shutting off the supply of water from the water supply control device 318 to the discharge valve hydraulic drive portion 314 when the water level has risen to a predetermined water level $L_1$.

Note that the internal structures of the water supply control device 318 and the electromagnetic valve 320 are the same as that of the water supply control device 18 and the electromagnetic valve 20 in the first embodiment explained with reference to FIG. 3, so an explanation thereof is here omitted.

Next we explain the operation of a flush water tank apparatus 304 and flush toilet apparatus 1 equipped with same, according to an embodiment of the disclosure. The internal operation of the water supply control device 318 and the electromagnetic valve 320 is explained with reference to the reference numerals assigned in FIG. 3.

First, in the above-described standby state of a flush toilet, the water level in the reservoir tank 310 is at predetermined water level $L_1$, and the solenoid coil 46 in the electromagnetic valve 320 (FIG. 3) is not being energized. In this state, the pilot valve opening 338*a* of the main valve body 338 and the float-side pilot valve opening 344*a* of the main body portion 336 are both in a closed valve state, and the valve seat 340 is closed by the main valve body 338 (see FIG. 3). Next, when a user presses the flush button on the remote control device 6 (FIG. 1), the remote control device 6 transmits a toilet flush command signal to the controller 328 (FIG. 6). Note that in the flush toilet apparatus 1 of the present embodiment, the toilet flush command signal is transmitted to the controller 328 after detection by the human presence sensor 8 (FIG. 1) that a user has separated from the seat, even when a predetermined time has elapsed, without the flush button of the remote control device 6 being pressed.

When a toilet flush command signal is received, the controller 328 energizes the solenoid coil 46 of the electromagnetic valve 320 (FIG. 3) and causes the electromagnetic valve-side pilot valve 50 to be separated from the pilot valve opening 338*a* of the main valve body 338. Pressure inside the pressure chamber 36*a* thus drops and the main valve body 38 separates from the valve seat 40, opening the valve seat 40. As a result, municipal water supplied from the water supply pipe 332 to the water supply control device 318 (FIG. 6) flows out from the water supply control device 318 and through the inflow pipe 324*a*.

In addition, water flowing within the inflow pipe 324*a* flows into the cylinder 314*a* of the discharge valve hydraulic drive portion 314. Water which has flowed into the cylinder 314*a* pushes the piston 314*b* upward against the biasing force of the spring 314*c*. The rod 315 linked to the piston 314*b* and the discharge valve 312 linked to the rod 315 are thus pulled up, separating the discharge valve 312 from the discharge opening 310*a*. That is, the discharge valve 312 is driven and opened by the supply pressure of municipal water supplied through the water supply pipe 332.

When the discharge valve 312 is opened, flush water (municipal water) stored in the reservoir tank 310 passes through the discharge opening 310*a* to be discharged into the bowl portion 2*a* of flush toilet main unit 2, thereby flushing the bowl portion 2*a*. When flush water in the reservoir tank 310 is discharged, the water level inside the reservoir tank 310 drops below predetermined water level $L_1$, therefore the water supply valve float 334 also drops. This causes arm portion 42 (FIG. 3) to turn so that the float-side pilot valve 44 separates from the float-side pilot valve opening 44*a*, opening the float-side pilot valve opening 44*a*.

Note that in a state in which the float-side pilot valve opening 44*a* is open, the pressure in the pressure chamber 36*a* rises even if the pilot valve opening 38*a* of the main valve body 38 is closed, therefore a state in which the main valve body 38 is separated from the valve seat 40 (the open valve state) can be maintained. For this reason, after the solenoid coil 46 is energized and the main valve body 338 is opened, the controller 328 stops energizing the solenoid coil 46 when a predetermined time has elapsed and the water level inside the reservoir tank 310 drops. The electromagnetic valve-side pilot valve 50 is thus pressed into the pilot valve opening 38*a* by the biasing force of the coil spring 52, but in a state in which the water level in the reservoir tank 10 has dropped, the float-side pilot valve opening 44*a* is opened, so the main valve body 38 remains separated from the valve seat 40. That is, the controller 328 is able to open the main valve body 38 with just a short time energizing the solenoid coil 46, so a single toilet flush can be executed with very low power consumption.

At the same time, when water flows from the inflow pipe 324*a* into the cylinder 314*a* of the discharge valve hydraulic drive portion 314 and the piston 314*b* is pushed up to the upper portion of the cylinder 314*a*, the water inside the cylinder 314*a* flows out through the outflow pipe 324*b*. Water passing through the outflow pipe 324*b* and flowing out rotates the generator 316 (not shown) to generate electrical power. Generated electrical power charges a capacitor (not shown) built into the controller 328. Water which has passed through the generator 316 is branched in the outflow pipe branching portion 324*c* and respectively flows into the reservoir tank 310 and the overflow pipe 310*b*. A portion of water flowing into the cylinder 314*a* from the inflow pipe 324*a* flows out from the gap 344*d* between the inside wall of the through-hole 314*f* in cylinder 314*a* and the rod 315; this water flows into the reservoir tank 310.

When the piston 314*b* is pushed up and the rod 315 and the discharge valve 312 are thereby pulled up to a predetermined position, the clutch mechanism 322 separates the lower rod 315*b* and the discharge valve 312 from the upper rod 315*a*. As a result, the upper rod 315*a* is pushed upward together with the piston 314*b*, while the lower rod 315*b* and the discharge valve 312 descend under their own weight. However, the separated lower rod 315*b* engages the latching portion 326*b* of the discharge valve float mechanism 326, stopping the descent of the lower rod 315*b* and the discharge valve 312. Thus the discharge opening 310*a* of the reservoir tank 310 remains open, and the discharge of water from the reservoir tank 310 is continued.

Here, when the water level in the reservoir tank 310 drops to a second predetermined water level $L_2$ below predetermined water level $L_1$, the float portion 326*a* of the discharge valve float mechanism 326 descends, moving the latching portion 326*b*. The engagement between the lower rod 315*b* and the latching portion 326*b* is thus released, and the lower rod 315*b* and the discharge valve 312 again start to descend. Thereafter, the discharge valve 312 causes the discharge opening 310*a* of the reservoir tank 310 to close, stopping the discharge of flush water to the flush toilet main unit 2. Even after the discharge opening 310*a* is closed, the valve seat 40 inside the water supply control device 318 is still in an open state, so water supplied from the water supply pipe 332 flows into the discharge valve hydraulic drive portion 314, and water flowing out from the discharge valve hydraulic drive portion 314 passes through the outflow pipe 324*b* to flow into the reservoir tank 310 so that the water level in the reservoir tank 310 rises.

When the water level in the reservoir tank 310 rises to a predetermined water level $L_1$, the water supply valve float 334 rises and the float-side pilot valve 44 is lowered by the arm portion 42, opening the float-side pilot valve opening 44*a*. By this means, the float-side pilot valve opening 44*a* and the pilot valve opening 38*a* of the main valve body 38 are closed, therefore the pressure in the pressure chamber 36*a* rises, and the main valve body 38 seats in the valve seat 40. As a result, the supply of water from the water supply control device 318 to the discharge valve hydraulic drive portion 314 is stopped, and the generation of electrical power by the generator 316 ends. The piston 314*b* of the discharge valve hydraulic drive portion 314 is pushed down by the biasing force of the spring 314*c*. The upper rod 315*a* and the lower rod 315*b*, which had been separated by the clutch mechanism 322, are again joined when the upper rod 315*a* is pushed down together with the piston 314*b*. Therefore when the toilet is next flushed, the upper rod 315*a* and the lower rod 315*b* will both be pulled up by the piston 314*b*. As explained above, when a toilet flush has completed, the flush toilet apparatus 1 is restored to a toilet flush standby state.

In the flush water tank apparatus 304 of a fourth embodiment of the disclosure, the generator 316 is disposed on the outflow pipe 324*b*, therefore water is supplied to the flush water tank apparatus 304 for toilet flushing, and the flow of water utilized to drive the discharge valve 312 in the discharge valve hydraulic drive portion 314 can also be used to generate electricity. By disposing the generator 316 in this way, all of the water supplied into the reservoir tank 310 except for water flowing out from the gap 314*d* can be made to contribute to electric generation, and the electrical power consumed by the electromagnetic valve 320 can be fully supplied. This enables the provision of a flush water tank apparatus 304 for supplying flush water to a flush toilet using self-generated electrical power.

In a flush water tank apparatus 304 of the present embodiment, a generator 316 is provided on the outflow pipe 324*b* in which water flowing out of the discharge valve hydraulic drive portion 314 flows, therefore it will not occur that the drive force from the discharge valve hydraulic drive portion 314 is insufficient to drive the discharge valve 312, even when large pressure losses occur due to the generator 316. This increases the degree of freedom in designing the generator, and enables adoption of a larger generator 316, such that electrical power consumed by the electromagnetic valve 320 can be fully satisfied by the power produced by the generator 316.

Furthermore, in the flush water tank apparatus 304 of the present embodiment, the outflow of water to the outflow pipe 324*b* placed on the generator 316 occurs after the piston 314*b* disposed in the cylinder 314*a* is moved to the second position, therefore a drive power deficiency from the discharge valve hydraulic drive portion 314 due to the presence of the generator 316 can be more reliably avoided.

Also, in the flush water tank apparatus 304 of the present embodiment, the outflow of water to the outflow pipe 324*b* is controlled by the piston 314*b* disposed inside the cylinder 314*a*, therefore the driving of the discharge valve 312 and the outflow of water to the outflow pipe 324*b* can both be controlled by a simple constitution.

In the above-described embodiments, electrical power generated by the generator 316 was stored in a capacitor built into the controller 328, however the present disclosure can also be constituted so that electrical power is stored in a battery rather than a capacitor. Also, in the above-described embodiment a clutch mechanism 322 was placed between the piston 314*b* and the discharge valve 312, but it is also possible to omit the clutch mechanism 322. In such cases, the outflow pipe 324*b* connected to the cylinder 314*a* may be connected to the bottom of the cylinder 314*a* to provide an opening and closing mechanism to open and close the inlet to the outflow pipe 324*b*. Also, in the above-described embodiment the piston 314*b* provided on the discharge valve hydraulic drive portion 314 was driven vertically, but it is also possible, for example, to constitute the disclosure so that the piston 314*b* is driven horizontally. In such cases it is desirable to provide a mechanism for converting the direction in which the piston 314*b* moves to a movement in the direction in which the discharge valve 312 is driven. In addition, in the above-described embodiments a gap was provided between the piston 314*b* bottom surface through-hole 314*f* and the rod 315, but is also acceptable to provide watertightness between the through-hole 314*f* and the rod 315. In addition, the present disclosure can be constituted so that the discharge valve 312 is driven by a mechanism rotated by water supply pressure rather than by the piston 314*b* in the discharge valve hydraulic drive portion 314.

Also, in the above-described embodiments the water supply control device 318 was constituted so that the main valve body was opened and closed by the pilot valve 40 driven by the electromagnetic valve 320, but the disclosure may also be constituted so that the main valve body 38 is directly opened and closed by the electromagnetic valve 320. In the above-described embodiment, the float-side pilot valve 44 (FIG. 3) was driven based on the motion of the float 334. As a variant example, the present disclosure can also be constituted so that a water level detection sensor is provided in place of the float 334, whereby the pilot valve is controlled by an electromagnetic valve based on a detection signal from the water level detection sensor. In such cases, an electromagnetic valve controlled based on a water level sensor detection signal may also be provided separately from the electromagnetic valve 320, which is controlled by a control signal from the controller 328. Alternatively a constitution may be adopted in which single electromagnetic valve 320 is controlled by a control signal from the controller 328 and a detection signal from a water level sensor.

What is claimed is:

1. A flush water tank apparatus for supplying flush water to a flush toilet using self-generated electrical power, comprising:

a reservoir tank configured to store the flush water to be supplied to the flush toilet, the reservoir tank including a discharge opening configured to discharge the stored flush water to the flush toilet;

a discharge valve configured to open and close to supply and shut off the flush water to the flush toilet;

a discharge valve hydraulic drive portion configured to drive the discharge valve by using supply pressure of supplied municipal water;

an electric generator configured to generate the electrical power using flow of the supplied municipal water;

an electromagnetic valve operated by the electrical power generated by the electric generator;

a water supply control device configured to control supply of water to the discharge valve hydraulic drive portion based on the operation of the electromagnetic valve, and to control supply and shuts off of supply of water to the reservoir tank;

a drive portion water supply conduit configured to direct water flowing out from the water supply control device to the discharge valve hydraulic drive portion;

a drive portion discharge conduit configured to discharge water flowing out of the discharge valve hydraulic drive portion to the reservoir tank and/or the flush toilet; and a clutch mechanism configured to connect the discharge valve hydraulic drive portion and the discharge valve, and to separate the discharge valve from the discharge valve hydraulic drive portion when the discharge valve is lifted to a predetermined height, wherein the electric generator is placed on either the drive portion water supply conduit or the drive portion discharge conduit, and generates the electrical power by means of the flow of water in either the drive portion water supply conduit or the drive portion discharge conduit while the water is supplied to the discharge valve hydraulic drive portion, and wherein, after the discharge valve is separated from the discharge valve hydraulic drive portion and the discharge opening is closed, the water supply control device continues the supply of water to the discharge valve hydraulic drive portion.

2. The flush water tank apparatus of claim 1, wherein the water supply control device is constituted so that water supplied from municipal water is supplied to the reservoir tank through the discharge valve hydraulic drive portion and the drive portion discharge conduit.

3. A flush toilet apparatus comprising:

the flush water tank apparatus of claim 1; and the flush toilet flushed by the supplying of the flush water from the flush water tank apparatus.

4. The flush water tank apparatus of claim 1, wherein a conduit connecting the discharge valve hydraulic drive portion and the electric generator extends in a horizontal direction.

5. The flush water tank apparatus of claim 1, wherein the electric generator is disposed on the drive portion water supply conduit, and generates the electrical power using the flow of water flowing in the drive portion water supply conduit.

6. The flush water tank apparatus of claim 5, wherein the discharge valve hydraulic drive portion comprises a cylinder into which water supplied from the water supply control device flows, a piston slidably disposed inside the cylinder and driven by pressure of the water flowing into the cylinder, and a rod, projecting from a through-hole formed on the cylinder so as to join the piston with the discharge valve, for driving the discharge valve;

whereby the water flowing into the cylinder flows out from a gap between an inner wall of the through-hole and the rod.

7. The flush water tank apparatus of claim 1, wherein the electric generator is disposed on the drive portion discharge conduit, and is configured to generate the electrical power using the flow of water flowing in the drive portion discharge conduit.

8. The flush water tank apparatus of claim 7, wherein the discharge valve hydraulic drive portion comprises a cylinder into which water flows from the drive portion water supply conduit, and a piston, slidably disposed within the cylinder so as to move from a first position to a second position when water flows in from the drive portion water supply conduit;

wherein when the piston moves to the second position, water which has flowed into the cylinder flows out of the drive portion discharge conduit.

9. The flush water tank apparatus of claim 8, wherein the drive portion discharge conduit communicates with an interior of the cylinder through an outflow hole placed in the cylinder, and when the piston is moved to the second position, the drive portion water supply conduit and the drive portion discharge conduit communicate through the interior of the cylinder.

10. The flush water tank apparatus of claim 1, wherein a conduit connecting the discharge valve hydraulic drive portion and the electric generator has a straight portion.

11. The flush water tank apparatus of claim 10, wherein the conduit connecting the discharge valve hydraulic drive portion and the electric generator extends in a horizontal direction.

* * * * *